US007546236B2

(12) United States Patent
Stentiford

(10) Patent No.: US 7,546,236 B2
(45) Date of Patent: Jun. 9, 2009

(54) ANOMALY RECOGNITION METHOD FOR DATA STREAMS

(75) Inventor: Frederick W M Stentiford, Woodbridge (GB)

(73) Assignee: British Telecommunications public limited company, London (GB)

( * ) Notice: Subject to any disclaimer, the term of this patent is extended or adjusted under 35 U.S.C. 154(b) by 608 days.

(21) Appl. No.: 10/506,181

(22) PCT Filed: Mar. 24, 2003

(86) PCT No.: PCT/GB03/01211

§ 371 (c)(1),
(2), (4) Date: Aug. 31, 2004

(87) PCT Pub. No.: WO03/081577

PCT Pub. Date: Oct. 2, 2003

(65) Prior Publication Data

US 2005/0143976 A1 Jun. 30, 2005

(30) Foreign Application Priority Data

| | | |
|---|---|---|
| Mar. 22, 2002 | (GB) | 0206851.8 |
| Mar. 22, 2002 | (GB) | 0206853.4 |
| Mar. 22, 2002 | (GB) | 0206854.2 |
| Mar. 22, 2002 | (GB) | 0206857.5 |

(51) Int. Cl.
*G10L 19/00* (2006.01)

(52) U.S. Cl. ..... 704/201; 704/236; 704/239

(58) Field of Classification Search ..... 704/236, 704/238, 239, 243, 244, 247, 270, 270.1, 704/211, 213, 216, 219, 220, 200, 201, 217, 704/218

See application file for complete search history.

(56) References Cited

U.S. PATENT DOCUMENTS 4,646,352 A 2/1987 Asai et al.

(Continued)

FOREIGN PATENT DOCUMENTS

EP 0098152 1/1984

(Continued)

OTHER PUBLICATIONS

International Search Report dated Mar. 18, 2002.
Lutton et al., "Contribution to the Determination of Vanishing Points Using Hough Transform", 1994 IEEE Transactions on Pattern Analysis and Machine Intelligence, vol. 16, No. 4, Apr. 1994, pp. 430-438.
McLean et al., "Vanishing Point Detection by Line Clustering", IEEE Transactions on Pattern Analysis and Machine Intelligence, vol. 17, No. 11, Nov. 1995, pp. 1090-1095.

(Continued)

*Primary Examiner*—Huyen X. Vo
(74) *Attorney, Agent, or Firm*—Nixon & Vanderhye PC

(57) ABSTRACT

This invention identifies anomalies in a data stream, without prior training, by measuring the difficulty in finding similarities between neighborhoods in the ordered sequence of elements. Data elements in an area that is similar to much of the rest of the scene score low mismatches. On the other hand a region that possesses many dissimilarities with other parts of the ordered sequence will attract a high score of mismatches. The invention makes use of a trial and error process to find dissimilarities between parts of the data stream and does not require prior knowledge of the nature of the anomalies that may be present. The method avoids the use of processing dependencies between data elements and is capable of a straightforward parallel implementation for each data element. The invention is of application in searching for anomalous patterns in data streams, which include audio signals, health screening and geographical data. A method of error correction is also described.

25 Claims, 26 Drawing Sheets

U.S. PATENT DOCUMENTS

| | | | | |
|---|---|---|---|---|
| 5,113,454 | A | 5/1992 | Marcantonio et al. | |
| 5,200,820 | A | 4/1993 | Gharavi | |
| 5,303,885 | A | 4/1994 | Wade | |
| 5,790,413 | A | 8/1998 | Bartusiak et al. | |
| 5,825,016 | A | 10/1998 | Nagahata et al. | |
| 5,867,813 | A | 2/1999 | Di Pietro et al. | |
| 5,978,027 | A | 11/1999 | Takeda | |
| 6,094,507 | A | 7/2000 | Monden | |
| 6,111,984 | A | 8/2000 | Fukasawa | |
| 6,240,208 | B1 | 5/2001 | Garakani et al. | |
| 6,266,676 | B1 | 7/2001 | Yoshimura et al. | |
| 6,282,317 | B1 | 8/2001 | Luo et al. | |
| 6,304,298 | B1 | 10/2001 | Steinberg et al. | |
| 6,389,417 | B1 | 5/2002 | Shin et al. | |
| 6,499,009 | B1 * | 12/2002 | Lundberg et al. | 704/211 |
| 6,778,699 | B1 | 8/2004 | Gallagher | |
| 6,934,415 | B2 | 8/2005 | Steintiford | |
| 2001/0013895 | A1 | 8/2001 | Aizawa et al. | |
| 2002/0081033 | A1 | 6/2002 | Stentiford | |
| 2002/0126891 | A1 | 9/2002 | Osberger | |
| 2005/0031178 | A1 | 2/2005 | Park | |
| 2005/0074806 | A1 | 4/2005 | Skierczynski et al. | |
| 2005/0169535 | A1 | 8/2005 | Stentiford | |
| 2006/0050993 | A1 | 3/2006 | Stentiford | |

FOREIGN PATENT DOCUMENTS

| | | | |
|---|---|---|---|
| EP | 1126411 | A1 | 8/2001 |
| EP | 1286539 | A1 | 2/2003 |
| GB | 1417721 | | 12/1975 |
| JP | 3-238533 | | 10/1991 |
| JP | 2002-50066 | | 2/2002 |
| WO | WO 82/01434 | | 4/1982 |
| WO | WO 90/03012 | | 3/1990 |
| WO | WO 99/05639 | | 2/1999 |
| WO | WO 99/60517 | | 11/1999 |
| WO | WO 00/33569 | | 6/2000 |
| WO | WO 01/31638 | A1 | 5/2001 |
| WO | WO 01/61648 | A2 | 8/2001 |
| WO | WO 02/21446 | A1 | 3/2002 |
| WO | WO 02/098137 | A1 | 12/2002 |
| WO | WO 03/081523 | A1 | 10/2003 |
| WO | WO 03/081577 | A1 | 10/2003 |
| WO | WO 2004/042645 | A1 | 5/2004 |
| WO | WO 2004/057493 | A2 | 8/2004 |
| WO | WO 2005/057490 | A2 | 6/2005 |
| WO | WO 2006/030173 | A1 | 3/2006 |

OTHER PUBLICATIONS

Koizumi et al., "A New Optical Detector for a High-Speed AF Control", 1996 IEEE, pp. 1055-1061.

Itti et al., "Short Papers: A Model of Saliency-Based Visual Attention for Rapid Scene Analysis", IEEE Transactions on Pattern Analysis and Machine Intelligence, vol. 20, No. 11, Nov. 1998, pp. 1254-1259.

Shufelt, "Performance Evaluation and Analysis of Vanishing Point Detection Techniques", In Analysis and Machine Intelligence, vol. 21, No. 3, Mar. 1999, pp. 282-288.

Wixson, "Detecting Salient Motion by Accumulating Directionally-Consistent Flow", IEEE Transactions on Pattern Analysis and Machine Intelligence, vol. 22, No. 8, Aug. 2000, pp. 774-780.

Privitera et al., "Algorithms for Defining Visual Regions-of-Interest: Comparison with Eye Fixations", IEEE Transactions on Pattern Analysis and Machine Intelligence, vol. 22, No. 9, Sep. 2000, pp. 970-982.

Smeulders et al., "Content-Based Image Retrieval at the End of the Early Years", IEEE Transactions on Pattern Analysis and Machine Intelligence, vol. 22, No. 12, Dec. 2000, pp. 1349-1380.

Vailaya et al., "Image Classification for Content-Based Indexing", IEEE Transactions on Image Processing, vol. 10, No. 1, Jan. 2001, pp. 117-130.

Almansa et al., "Vanishing Point Detection Without Any A Priori Information", IEEE Transactions on Pattern Analysis and Machine Intelligence, vol. 25, No. 4, Apr. 2003, pp. 502-507.

Santini et al., "Similarity Matching", Proc 2nd Asian Conf on Computer Vision, pp. II 544-548, IEEE, 1995.

Rui et al., "A Relevance Feedback Architecture for Content-Based Multimedia Information Retrieval Systems", 1997 IEEE, pp. 82-89.

Walker et al., "Locating Salient Facial Features Using Image Invariants", Proc. 3rd IEEE International Conference on Automatic Face and Gesture Recognition, 1998, pp. 242-247.

Mahlmeister et al., "Sample-guided Progressive Image Coding", Proc. Fourteenth Int. Conference on Pattern Recognition, Aug. 16-20, 1998, pp. 1257-1259, vol. 2.

Osberger et al., "Automatic Identification of Perceptually Important Regions in an Image", Proc. Fourteenth Int. Conference on Pattern Recognition, Aug. 16-20, 1998, pp. 701-704, vol. 1.

Buhmann et al., "Dithered Colour Quantisation", Eurographics 98, Sep. 1998, http://opus.fu-bs.de/opus/volltexte/2004/593/pdf/TR-tubs-cq-1998-01.pdf.

Rui et al., "Relevance Feedback: A Power Tool for Interactive Content-Based Image Retrieval", IEEE Transactions on Circuits and Systems for Video Technology, vol. 8, No. 5, Sep. 1998, pp. 644-655.

Gallet et al., "A Model of the Visual Attention to Speed up Image Analysis", Proceedings of the 1998 IEEE International Conference on Image Processing (ICIP-98), Chicago, Illinois, Oct. 4-7, 1998, IEEE Computer Society, 1998, ISBAN-08186-8821-1, vol. 1, pp. 246-250.

Curtis et al., "Metadata—The Key to Content Management Services", 3rd IEEE Metadata Conference, Apr. 6-7, 1999.

Stentiford, "Evolution: The Best Possible Search Algorithm?", BT Technology Journal, vol. 18, No. 1, Jan. 2000, (Movie Version).

Rother, "A New Approach for Vanishing Point Detection in Architectural Environments", 11th British Machine Vision Conference, Bristol, UK, Sep. 2000, http://www.bmva.ac.uk/bmvc/2000/papers/p39.pdf.

Sebastian et al., "Recognition of Shapes by Editing Shock Graphs", Proc. ICCV 2001, pp. 755-762.

Stentiford et al., "Automatic Identification of Regions of Interest with Application to the Quantification of DNA Damage in Cells", Human Vision and Electronic Imaging VII, B.E. Rogowitz, T.N. Pappas, Editors, Proc. SPIE vol. 4662, pp. 244-253, San Jose, Jan. 20-26, 2002.

Xu et al., "Video Summarization and Semantics Editing Tools", Storage and Retrieval for Media Databases, Proc. SPIE, vol. 4315, San Jose, Jan. 21-26, 2001.

Stentiford, "An Estimator for Visual Attention Through Competitive Novelty with Application to Image Compression", Picture Coding Symposium 2001, Apr. 25-27, 2001, Seoul, Korea, pp. 101-104, http://www.ee.ucl.ac.uk/-fstentif/PCS2001-pdf.

Cantoni et al., "Vanishing Point Detection: Representation Analysis and New Approaches", 11th Int. Conf. on Image Analysis and Processing, Palermo, Italy, Sep. 26-28, 2001.

Ouerhani et al., "Adaptive Color Image Compression Based on Visual Attention", Proc. 11th Int. Conference on Image Analysis and Processing, Sep. 26-28, 2001, pp. 416-421.

Russ et al., "Smart Realisation: Delivering Content Smartly", J. Inst. BT Engineers, vol. 2, Part 4, pp. 12-17, Oct.-Dec. 2001.

Bradley et al., "JPEG 2000 and Region of Interest Coding", Digital Imaging Computing—Techniques and Applications, Melbourne, Australia, Jan. 21-22, 2002.

Roach et al., "Recent Trends in Video Analysis: A Taxonomy of Video Classification Problems", 6th IASTED Int. Conf. on Internet and Multimedia Systems and Applications, Hawaii, Aug. 12-14, 2002, pp. 348-353.

Bradley et al., "Visual Attention for Region of Interest Coding in JPEG 2000", Journal of Visual Communication and Image Representation, vol. 14, pp. 232-250, 2003.

Stentiford, "An Attention Based Similarity Measure with Application to Content-Based Information Retrieval", Storage and Retrieval for Media Databases 2003, M.M. Yeung, R.W. Lienhart, C-S Li, Editors, Proc SPIE vol. 5021, Jan. 20-24, Santa Clara, 2003.

Stentiford, "the Measurement of the Salience of Targets and Distractors through Competitive Novelty", 26th European Conference on Visual Perception, Paris, Sep. 1-5, 2003, (Poster).
Stentiford, "An Attention Based Similarity Measure for Fingerprint Retrieval", Proc. 4th European Workshop on Image Analysis for Multimedia Interactive Services, pp. 27-30, London, Apr. 9-11, 2003.
Okabe et al., Object Recognition Based on Photometric Alignment Using RANSAC, Proceedings of the 2003 IEEE Computer Society Conference on Computer Vision and Pattern Recognition (CVPR'03), vol. 2, pp. 221-228, Jun. 19-20, 2003.
Oyekoya et al., "Exploring Human Eye Behaviour Using a Model of Visual Attention", International Conference on Pattern Recognition 2004, Cambridge, Aug. 23-26, 2004, pp. 945-948.
Stentiford, "A Visual Attention Estimator Applied to Image Subject Enhancement and Colour and Grey Level Compression", International Conference on Pattern Recognition 2004, Cambridge, Aug. 23-26, 2004, pp. 638-641.
Rasmussen, "Texture-Based Vanishing Point Voting for Road Shape Estimation", British Machine Vision Conference, Kingston, UK, Sep. 2004, http://www.bmva.ac.uk/bmvc/2004/papers/paper_261.pdf.
Finlayson et al., "Illuminant and Device Invariant Colour Using Histogram Equalisation", Pattern Recognition, vol. 38, No. 2 (Feb. 2005), pp. 179-190.
Stentiford, "Attention Based Facial Symmetry Detection", International Conference on Advances in Pattern Recognition, Bath, UK, Aug. 22-25, 2005.
Stentiford, "Attention Based Symmetry Detection in Colour Images", IEEE International Workshop on Multimedia Signal Processing, Shanghai, China, Oct. 30-Nov. 2, 2005.
Wang et al., "Efficient Method for Multiscale Small Target Detection from a Natural Scene", 1996 Society of Photo-Optical Instrumentation Engineers, Mar. 1996, pp. 761-768.
Rohwer et al., "The Theoretical and Experimental Status of the n-Tuple Classifier", Neural Networks, vol. 11, No. 1, pp. 1-14, 1998.
Brown, A Survey of Image Registration Techniques, ACM Computing Surveys, vol. 24, No. 4, Dec. 1992, pp. 325-376.
Zhao et al., "Face Recognition: A Literature Survey", CVLK Technical Report, University of Maryland, Oct. 2000, ftp://ftp.cfar.umd.edu/TRs/CVL-Reports-2000/TR4167-zhao.ps.qz.
Stentiford, "An Evolutionary Programming Approach to the Simulation of Visual Attention", CEC 2001, published May 29, 2001.
Zhao et al., "Morphology on Detection of Calcifications in Mammograms", Digital Signal Processing 2, Estimation, VLSI. San Francisco, Mar. 23-26, 1992, Proceedings of the International Conference on Acoustics, Speech and Signal Processing (ICASSP), New York, IEEE, US, vol. 5, Conf. 17, Mar. 23, 1992, pp. 129-132, XP010059006.
Raeth et al., "Finding Events Automatically in Continuously Sampled Data Streams via Anomaly Detection", Proceedings of the IEEE 2000 National Aerospace and Electronics Conference, NAECON 2000, Engineering Tomorrow (CAT. No. 00CH37093), Proceedings of the IEEE 200 National Aerospace and Electronics Conference, NAECON 2000, Engineering Tomorrow, Dayton, pp. 580-587, XP002224776.
Stentiford et al, "An Evolutionary Approach to the Concept of Randomness", The Computer Journal, pp. 148-151, Mar. 1972.
International Search Report.
European Search Report—Jan. 8, 2003 for RS 108248 GB.
European Search Report—Jan. 9, 2003 for RS 108249 GB.
European Search Report—Jan. 9, 2003 for RS 108251 GB.
European Search Report—Jan. 8, 2003 for RS 108250 GB.
International Search Report mailed Feb. 9, 2006 in International Application No. PCT/GB2005/003339.
Chang et al., "Fast Algorithm for Point Pattern Matching: Invariant to Translations, Rotations and Scale Changes", Pattern Recognition, vol. 30, No. 2, Feb. 1997, pp. 311-320.

* cited by examiner n : 0 to 3, Mismatch if $|x_n - y_n| >$ threshold

Radius = 3
Neighbourhood size = 3
Comparison domain = region where y is chosen

Fig.9.

Result 1

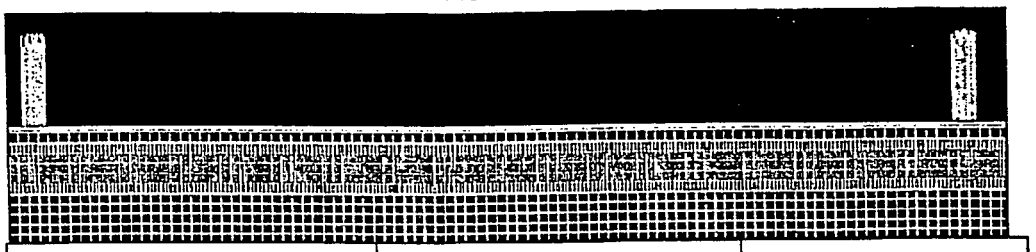

| | | |
|---|---|---|
| Binary sequence of 0's and 1's. 500 elements in total. | 500 comparisons, radius = 5, neighbourhood size = 4, threshold = 0 | Perfect discrimination of anomaly |

Fig.10.

Result 2

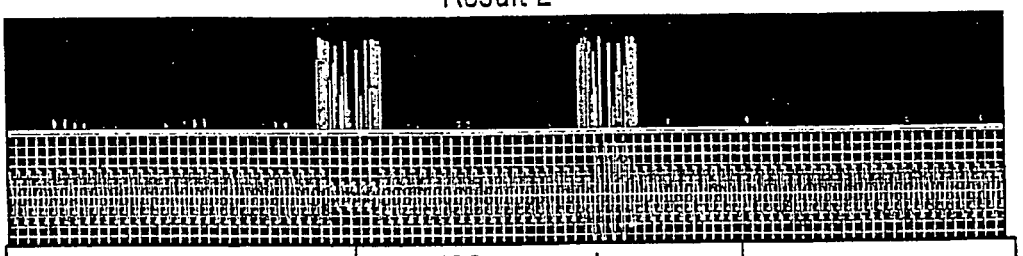

| | | |
|---|---|---|
| Sine wave with change in amplitude | 500 comparisons, radius = 5, neighbourhood size = 4, threshold = 0.01 | Perfect discrimination of anomaly |

Fig.11.

Result 3

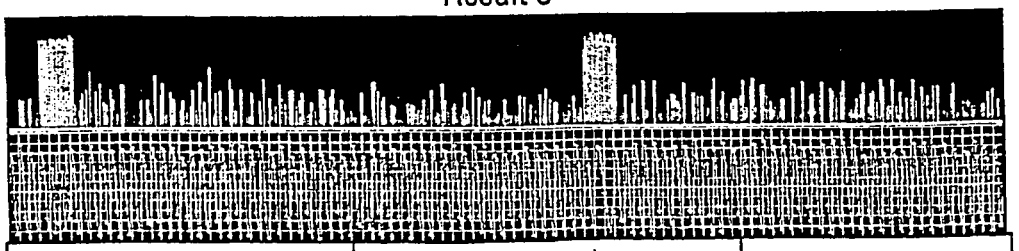

| | | |
|---|---|---|
| Sine wave with background noise and burst and delay error | 500 comparisons, radius = 5, neighbourhood size = 4, threshold = 0.15 | Good discrimination of anomaly |

Result 4

| | | |
|---|---|---|
| 22kHz sampling rate, 440Hz sine wave with clipping | 1000 comparisons, radius = 75, neighbourhood size = 4, threshold = 0.15 | Good discrimination Gap in between the peaks can be eliminated with larger neighbourhood size |

Result 5

| | | |
|---|---|---|
| 11kHz sampling rate, 440Hz sine wave with clipping | 1000 comparisons, radius = 10, neighbourhood size = 5, threshold = 0.15 | Good discrimination of anomaly |

Result 6

| | | |
|---|---|---|
| 44kHz sampling rate, 440Hz sine wave with phase shift | 1000 comparisons, radius = 50, neighbourhood size = 4, threshold = 0.1 | Good discrimination of anomaly |

Result 7

| | | |
|---|---|---|
| 44kHz sampling rate, 440Hz sine wave with phase shift | 1000 comparisons, radius = 50, neighbourhood size = 4, threshold = 0.1 | Near perfect dicrimination of anomaly |

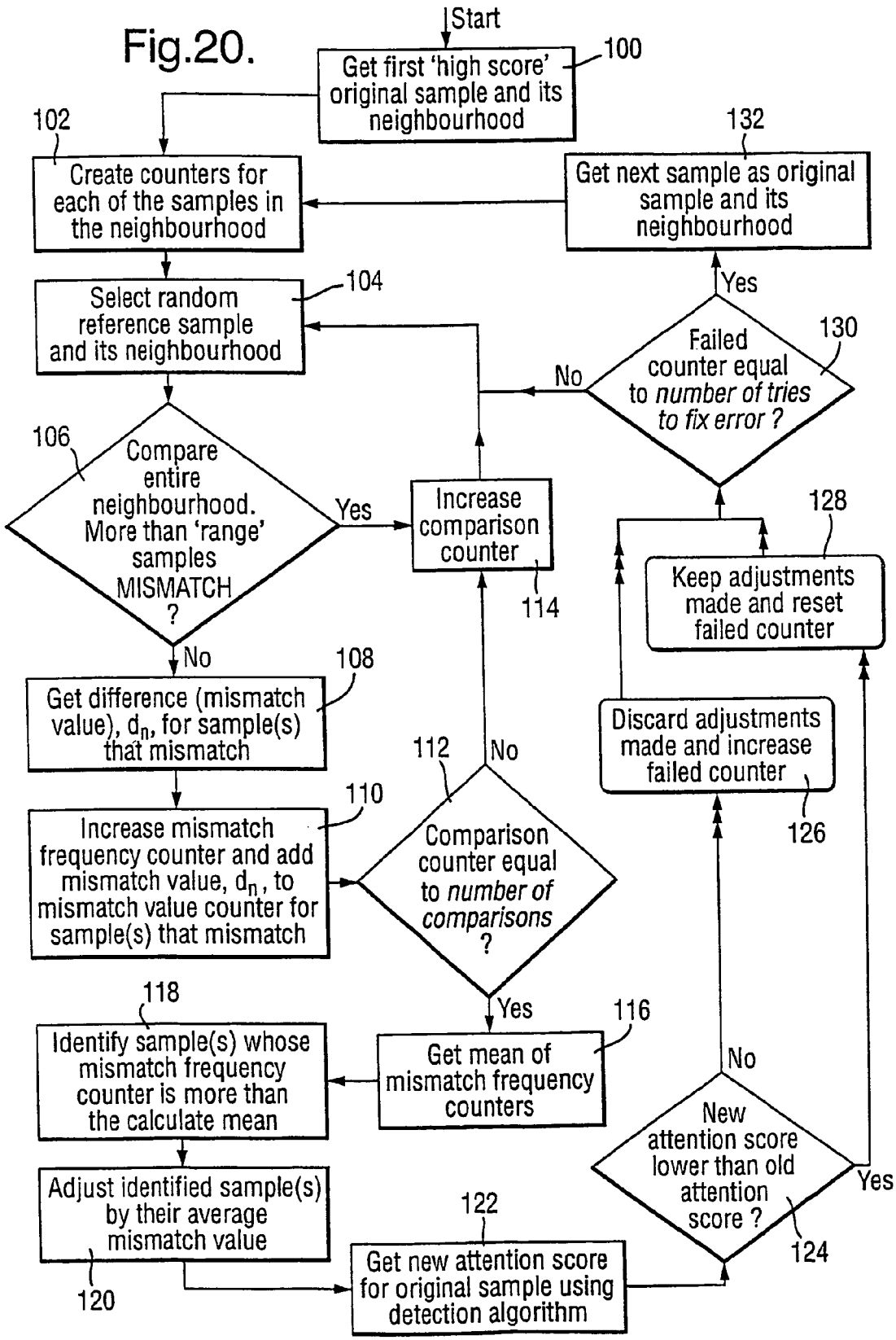
Fig.20.
Start
Get first 'high score' original sample and its neighbourhood
100
102
Create counters for each of the samples in the neighbourhood
132
Get next sample as original sample and its neighbourhood
Select random reference sample and its neighbourhood
104
Yes
Failed counter equal to number of tries to fix error ?
130
No
106
Compare entire neighbourhood. More than 'range' samples MISMATCH ?
Yes
Increase comparison counter
114
128
Keep adjustments made and reset failed counter
No
108
Get difference (mismatch value), $d_n$, for sample(s) that mismatch
112
No
Discard adjustments made and increase failed counter
126
110
Increase mismatch frequency counter and add mismatch value, $d_n$, to mismatch value counter for sample(s) that mismatch
Comparison counter equal to number of comparisons ?
118
Yes
116
Identify sample(s) whose mismatch frequency counter is more than the calculate mean
Get mean of mismatch frequency counters
No
New attention score lower than old attention score ?
Yes
Adjust identified sample(s) by their average mismatch value
122
124
120
Get new attention score for original sample using detection algorithm Result 8

| | | |
|---|---|---|
| 44kHz sampling rate, 440Hz sine wave with phase shift | 250 comparisons, threshold = 0.15 | Perfect discrimination of anomalous cycles |

Fig.30.

Result 2

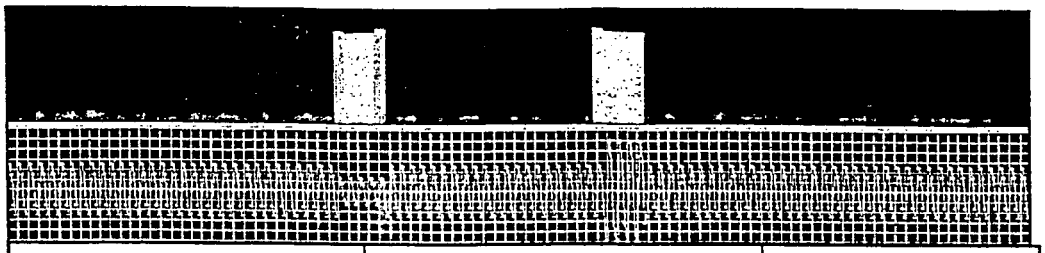

| | | |
|---|---|---|
| Sine wave with change in amplitude | 250 comparisons, threshold = 0.1 (not critical) | Perfect discrimination of anomalous cycles |

Fig.31.

Result 3

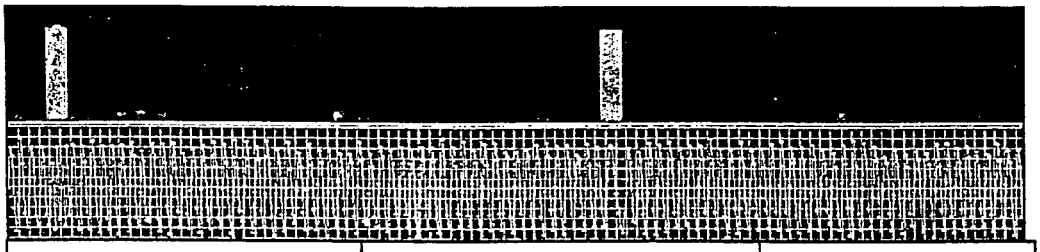

| | | |
|---|---|---|
| Sine wave with background noise and burst and delay error | 250 comparisons, threshold = 0.1 | Perfect discrimination of anomalous cycles |

Fig.32.

Result 4

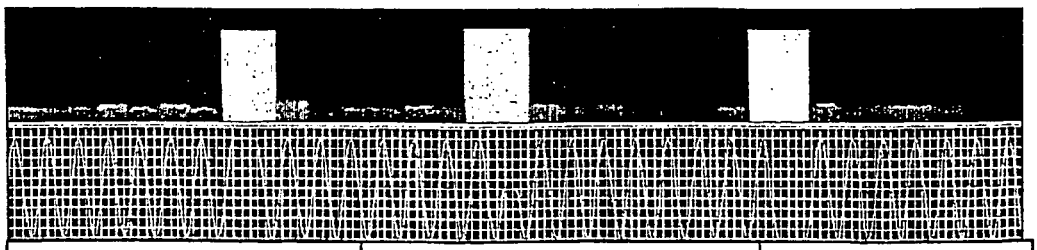

| | | |
|---|---|---|
| 22kHz sampling rate, 440Hz sine wave with clipping | 250 comparisons, threshold = 0.15 | Perfect discrimination of anomalous cycles |

Result 5

| | | |
|---|---|---|
| 44kHz sampling rate, 440Hz sine wave with phase shift | 250 comparisons, threshold = 0.15 | Perfect discrimination of anomalous cycles |

Result 6

| | | |
|---|---|---|
| 44kHz sampling rate, 440kHz sine wave with clipping | 250 comparisons, threshold = 0.15 | Near perfect discrimination of anomalous cycles |

Fig.35.

Result 7

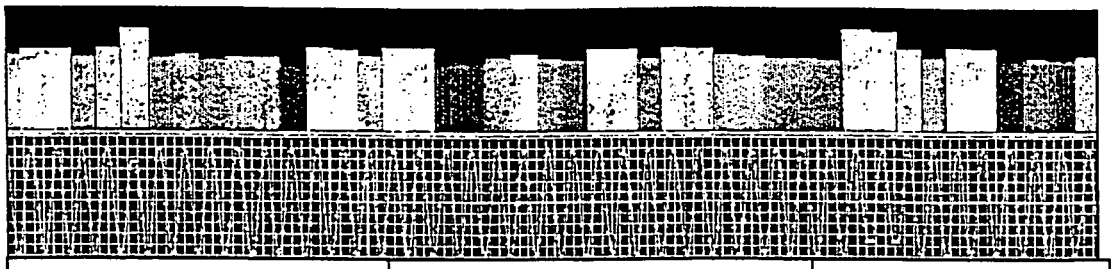

| | | |
|---|---|---|
| 11kHz sampling rate, 440Hz sine wave with clipping | 250 comparisons, threshold = 0.05 (critical due to low sampling rate) | Less satisfactory due to low sampling rate. Would have performed much better if sampling rate is increased. |

Fig.36.

Result 8

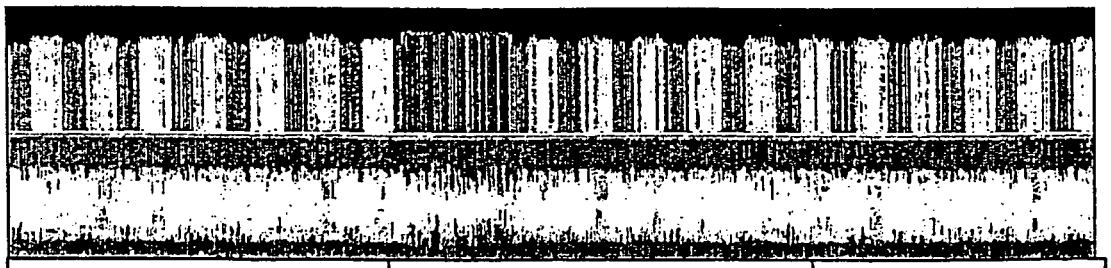

| | | |
|---|---|---|
| 6kHz sampling rate, 440Hz ± 220Hz modulated sine wave | 500 comparisons, threshold = 0.15 | Average score increases, but still manages to identify anomalous region |

Fig.37.

Result 9

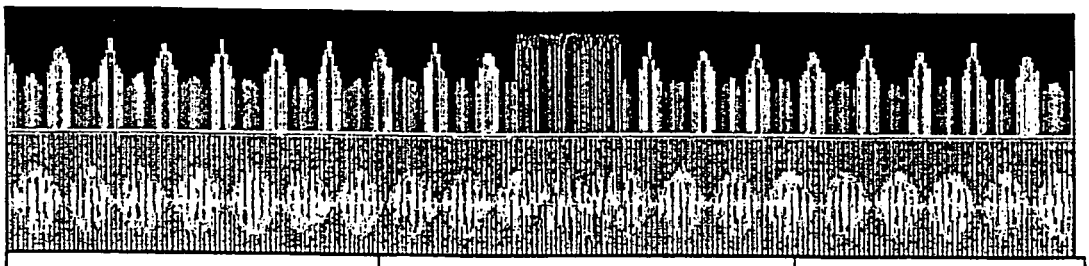

| | | |
|---|---|---|
| 6kHz sampling rate, 440Hz amplitude modulated sine wave | 250 comparisons, threshold = 0.15 | Good discrimination except for striation effects |

Fig.38.

Result 10

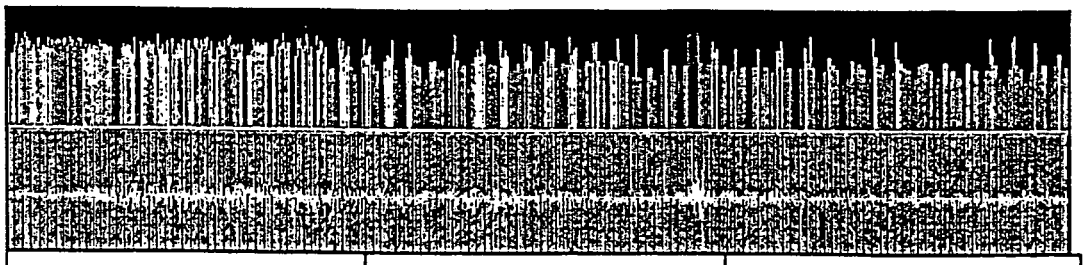

| | | |
|---|---|---|
| 11kHz sampling rate, Guitar chord (real audio data) with burst of noise | 250 comparisons, threshold = 0.015, domain = 175 (critical due to morphing cycles) | Manages to identify noise very well. Attack and decay region gets high attention as well. |

ANOMALY RECOGNITION METHOD FOR DATA STREAMS

This application is the U.S. national phase of international application PCT/GB03/01211 filed 24 Mar. 2003 which designated the U.S. and claims benefit of GB's 0206851.8, 0206853.4, 0206854.2 and 0206857.5, all dated 22 Mar. 2002, the entire content of which is hereby incorporated by reference.

BACKGROUND

1. Technical Field

This invention relates to a system for recognising anomalies contained within a set of data derived from an analogue waveform, particularly, though not exclusively, for locating noise in an audio signal. The invention may be applied to data from many different sources, for example, in the medical field to monitor signals from a cardiogram or encephalogram. It also has application in the field of monitoring machine performance, such as engine noise. A noise removal system is also described for use in combination with the present invention.

2. Related Art

Audio signals may be subject to two principal sources of noise: impulse noise and continuous noise.

There are a number of existing techniques for dealing with both sorts of noise. In particular, in order reduce the effects of continuous noise, such as a background "hum" in audio data, low-pass filters, dynamic filters, expanders and spectral subtraction are used. However, these techniques suffer from the disadvantage that the characteristic of the noise must be known at all times. The nature of noise makes it impossible to perfectly characterise it. Thus, in practice, even the most sophisticated filters remove genuine signal that is masked by the noise, as a result of the noise being imperfectly characterised. Using these techniques noise can only be removed with any degree of success from signals, such as speech signals, where the original signal is known.

Impulsive noise, such as clicks and crackles, is even more difficult to process because it cannot be characterised using dynamic, time resolved techniques. There are techniques for correcting the signal. However, problems remain in identifying the noise in the first place. Most impulsive noise removal techniques assume that the noise can be detected by simple measurements such as an amplitude threshold. However, noise is in general unpredictable and can never be identified in all cases by the measurement of a fixed set of features. It is extremely difficult to characterise noise, especially impulsive noise. If the noise is not fingerprinted accurately all attempts at spectral subtraction do not produce satisfactory results, due to unwanted effects. Even if the noise spectrum is described precisely, the results are dull due in part because the spectrum is only accurate at the moment of measurement.

Known impulse noise removal techniques include attenuation, sample and hold, linear interpolation and signal modeling. Signal modeling, as for example described in "Cedaraudio", Chandra C, et al, "An efficient method for the removal of impulse noise from speech and audio signals", Proc. IEEE International Symposium on Circuits and Systems, Monterey, Calif., Jun. 1998, pp 206-209, endeavours to replace the corrupted samples with new samples derived from analysis of adjacent signal regions. In this particular prior art technique, the correction of impulsive noise is attempted by constructing a model of the underlying resonant signal and replacing the noise by synthesised interpolation. However, notwithstanding the need to accurately detect the noise in the first place, this approach only works in those cases in which the model suits the desired signal and does not itself generate obtrusive artifacts.

BRIEF SUMMARY

Exemplary embodiments of the present invention provides a solution to the problems identified above with respect to noise identification and removal in data derived from an analogue waveform, in particular in audio signals. We have found that a technique developed, and described in our copending application EP-A-1 126 411, for locating anomalies in images, can be applied to data streams, in particular to audio signals. Our copending application describes a system which is able to analyze an image (2-D data) and highlight the regions that will 'stand out' to a human viewer and hence is able to simulate the perception of a human eye looking at objects.

Aspects of the present invention are provided as specified in the appended claims.

The first exemplary method of the invention allow for anomaly recognition in a data sequence, which is independent of the particular anomaly. As a specific example, this method will identify noise in a data sequence irrespective of the characteristics of the noise.

The present exemplary embodiments provide the advantage that is necessary for the signal or the anomaly to be characterized. An anomaly is identified by its distinctiveness against an acceptable background rather than through the measurement of specific features. By measuring levels of auditory attention, an anomaly can be detected. Further, the exemplary embodiment does not rely upon specific features and is not limited in the forms of anomalies that can be detected. The problem of characterizing the anomaly need not be encountered.

Further, the exemplary embodiment need not rely upon specific features and is not limited in the forms of noise that can be detected. The problem of characterizing the noise need not be encountered.

One exemplary method includes the further steps of: identifying ones of said positional relationships which give rise to a number of consecutive mismatches which exceeds a threshold, storing a definition of each such identified relationship, utilizing the stored definitions for the processing of further data, and, replacing said identified ones with data which falls within the threshold. Having accurately identified the noise segment on the basis of its attention score, this method ensures that the noise is replaced by segments of signal that possess low scores and hence reduces the level of auditor attention in that region. Thus, in contrast to prior art techniques, such as "Cedaraudio", this preferred method does not require any signal modeling.

This apparatus of the invention is preferably embodied in a general purpose computer, suitably programmed.

The invention also extends to a computer programmed to perform the methods of the invention, and to a computer program product directly loadable into the internal memory of a digital computer, comprising software code portions for performing the steps of the method of the invention, when said product is run on a computer.

This method allows for anomaly recognition in a data array, which is independent of the particular anomaly. As a specific example, this method will identify an anomaly in a data array irrespective of the characteristics of the noise.

BRIEF DESCRIPTION OF THE DRAWINGS

In order that the invention may be more fully understood embodiments thereof will now be described by way of example only, with reference to the figures, in which

FIG. 9 shows Result 1;

FIG. 10 shows Result 2;

FIG. 11 shows Result 3;

FIG. 20 is a flow chart depicting the steps of shape learning error correction;

FIG. 29 shows Result 1a;

FIG. 30 shows Result 2a;

FIG. 31 shows Result 3a;

FIG. 32 shows Result 4a;

FIG. 33 shows Result 5a;

FIG. 34 shows Result 6a;

FIG. 35 shows Result 7a;

FIG. 36 shows Result 8a;

FIG. 37 shows Result 9a;

FIG. 38 shows Result 10a;

DETAILED DESCRIPTION OF EXEMPLARY EMBODIMENTS

The ordered sequence of elements which form the data is represented in an array derived from an analogue waveform. Although the data may be a function of more than ne variable, in this invention the data is "viewed" or ordered in dependence on one variable. Thus, the data can be stored as an array. The array is a one dimensional array, a 1×n matrix. Data in a one dimensional array is also referred hereinbelow as one dimensional data. The values of the data contained in the array may be a sequence of binary values, such as an array of digital samples of an audio signal. One example of the anomaly recognition procedure is described below in connection with FIGS. 1-8, where the neighbouring elements of $x_0$ are selected to be within some one-dimensional, distance of $x_0$. (Distance between two elements or sample points in this example may be the number of elements between these points).

Detection of anomalies in data represented in a one-dimensional array (eg: time resolved data or audio data or data from an acoustic source) concerns instructing a computer to identify and detect irregularities in the array in which the set of data is arranged. There are various reasons why a particular region can be considered as 'irregular' or 'odd'. It could be due to its odd shape or values when compared with the population data (the remainder of the data); it could be due to misplacement of a certain pattern in a set of ordered pattern. Put more simply, an anomaly or irregularity, is any region which is considered different to the rest of the data due to its low occurrence within the data: that is, anomalous data will have one or more characteristics which are not the same as those of the majority of the data.

In the specific examples given in the description of the invention, the algorithm is tested mainly on audio data with the discrete samples as the one-dimensional data. However, the invention is limited in no way to audio data and may include other data that can be represented in a one dimensional array derived from a waveform having a plurality of cycles.

The software which, when run on a computer implements the present invention, "One Dimensional Anomaly Detector", is written in Curl language using Curl Surge Lab IDE beta 5—Build: 1.6.0 release/englewood/0-1237: copyright© 1998-2001 and may not be compatible with future releases of Curl. The results shown in this description were produced by the software mentioned above. Again, however, the invention is not limited to software written using this particular language and may be implemented using other computer languages.

This algorithm of the present invention works on the basis of analysing samples. A further algorithm described later as the "cycle comparison algorithm" compares cycles defined by certain zero crossings.

The method for the sample analysis algorithm will now be described with reference to FIGS. 1 to 8.

Figure 4:
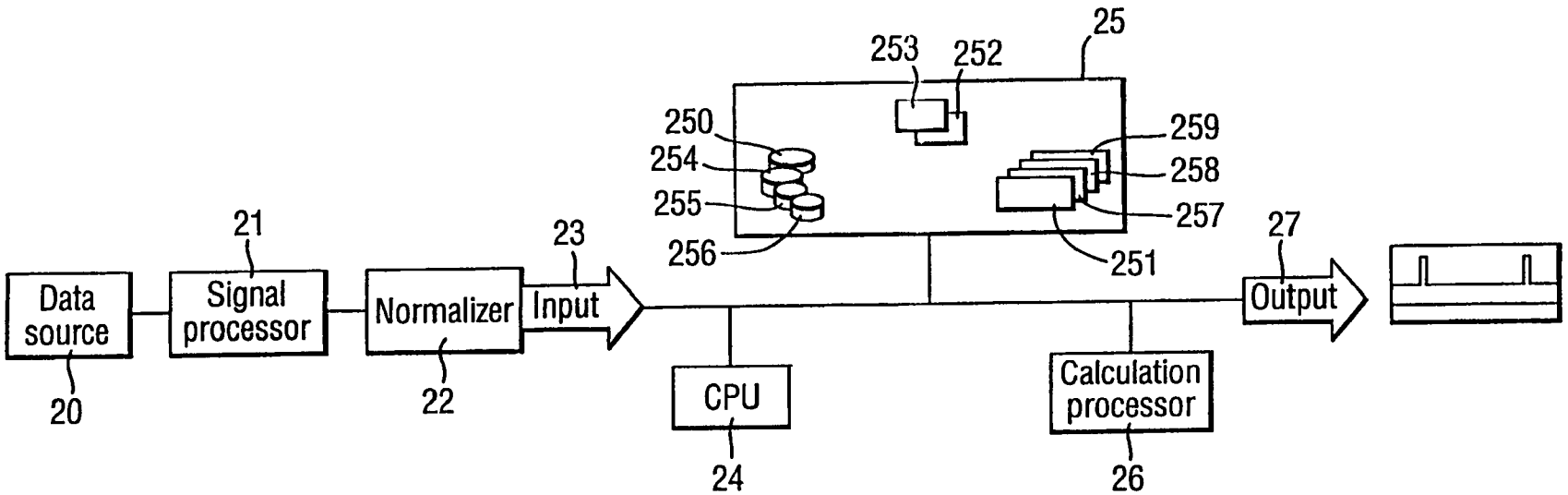
FIG. 4 illustrates schematically the basic components of a general purpose computer capable of performing the invention.

The components shown in FIG. 4 include a data source 20 and a signal processor 21 for processing the data. The data is either generated or pre-processed using Cool Edit Pro—version 1.2: Cool Edit Pro is copyrighted© 1997-1998 by Syntrillium software Corporation. Portions of Cool Edit Pro are copyrighted© 1997, Massachusetts Institute of Technology. The invention is not limited in this respect, however, and is suitable for data generated or preprocessed using other techniques. FIG. 4 also shows a normaliser 22. The data is normalised by dividing all values by the maximum modulus value of the data so that the possible values of the data range from −1 to 1.

A central processing unit (CPU) 24, an output unit 27 such as a visual display unit (VDU) or printer, a memory 25 and a calculation processor 26. The memory 25 includes stores 250, 254-256, registers 251, 257-259 and a mismatch counter 253 and a comparison counter 252. The data and the programs for controlling the computer are stored in the memory 25. The CPU 24 controls the functioning of the computer using this information.

With further reference to FIGS. 1-5, a data stream to be analysed is received at the input means 23 and stored in a digital form in a data store 250, as a one dimensional array, where each datum or data element has a value attributed to it.

An original sample of data, x0, (a reference test element) is selected (step 1) from the one dimensional array, and its value is stored in an original sample register 251. A mismatch count, cx, stored in a mismatch counter 253, and a count of the number of data comparisons, Ix, stored in a comparison counter 252, are both set to zero (step 2).

Then a random neighbourhood, x1, x2, x3, (test elements) which comprises a number of data in the vicinity of the original sample (reference test element), x0, of a certain size (PARAMETER: neighbourhood size) is selected from neighbouring samples (step 5). The neighbourhood is chosen to lie within a particular range (or "neighbourhood range") (PARAMETER: radius) from the original sample, x0.

Then, a second reference sample, y0, is randomly chosen anywhere within a certain domain or range (PARAMETER: comparison domain) in the set of data (step 6). The neighbourhood, (i.e. test elements) x1, x2, x3 selected around the original sample, x0 together with the original sample, x0, have a certain configuration which makes a 'pattern'.

The neighbourhood, y1, y2, y3, (comparison elements) selected around the random reference sample, (the reference comparison element) y0, together with the reference sample, y0, are chosen to have the same configuration, or pattern, as the neighbourhood around the original sample.

Figure 1:
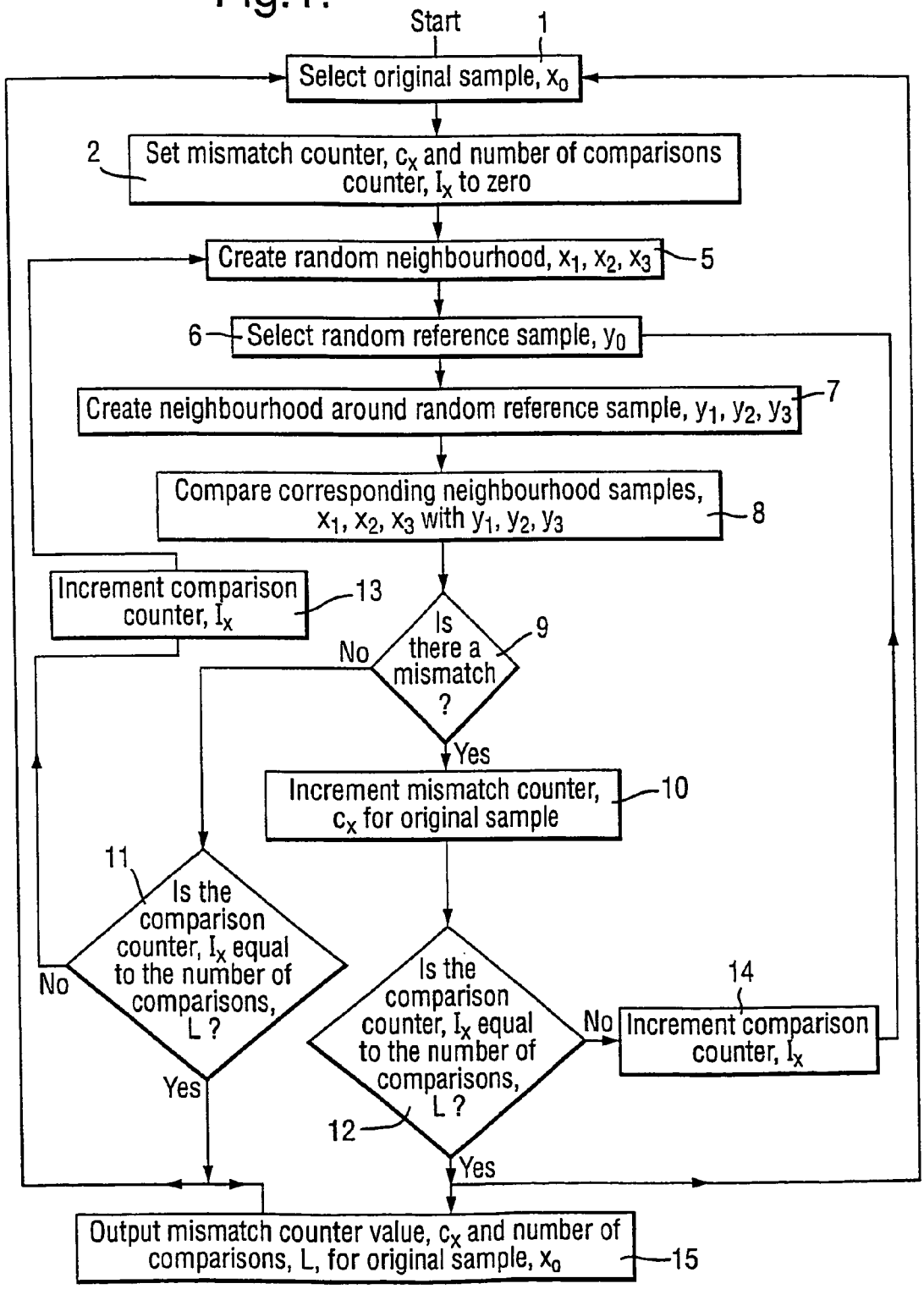
FIG. 1 is a flowchart which illustrates schematically the operation of an embodiment of the invention.
Figure 2:
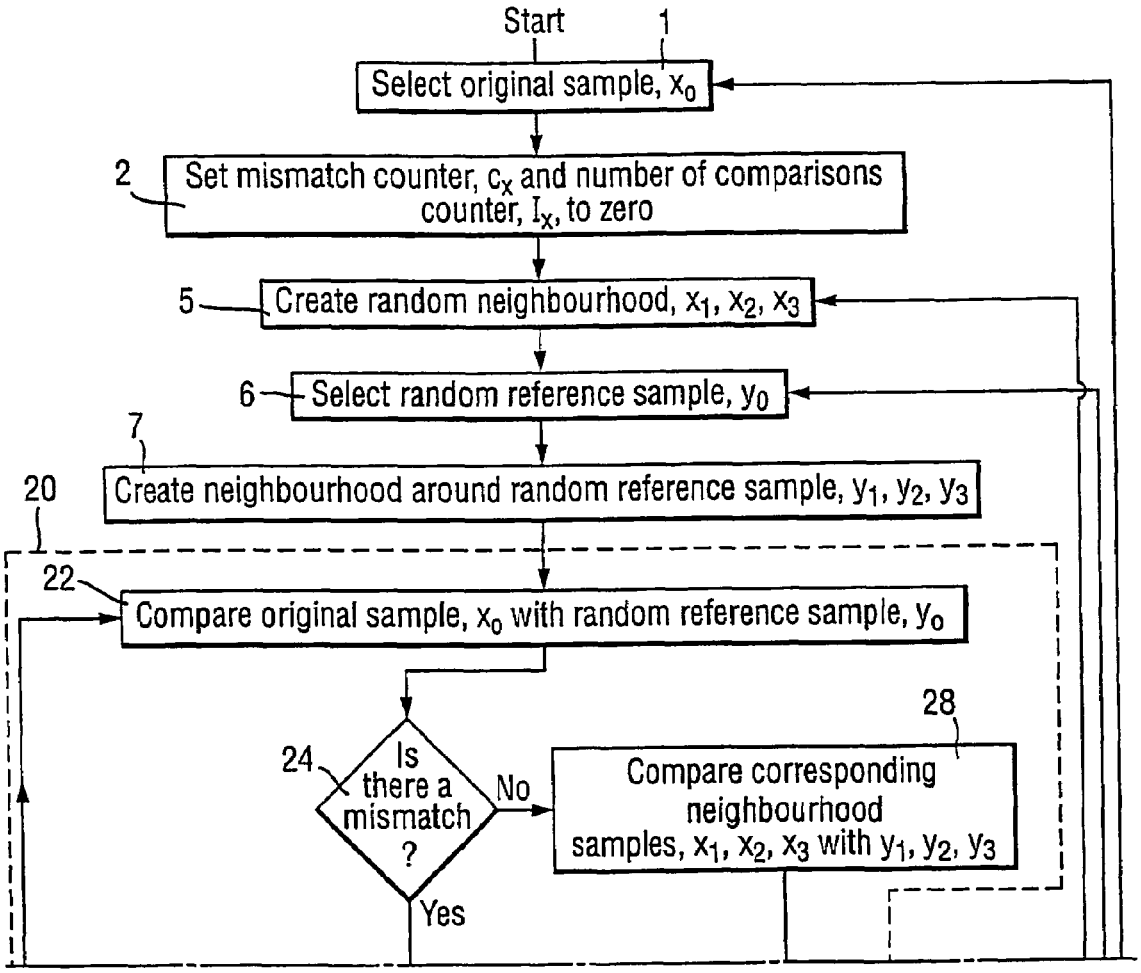
FIG. 2 is a flowchart which illustrates schematically the operation of a further embodiment of the invention.
Figure 2:
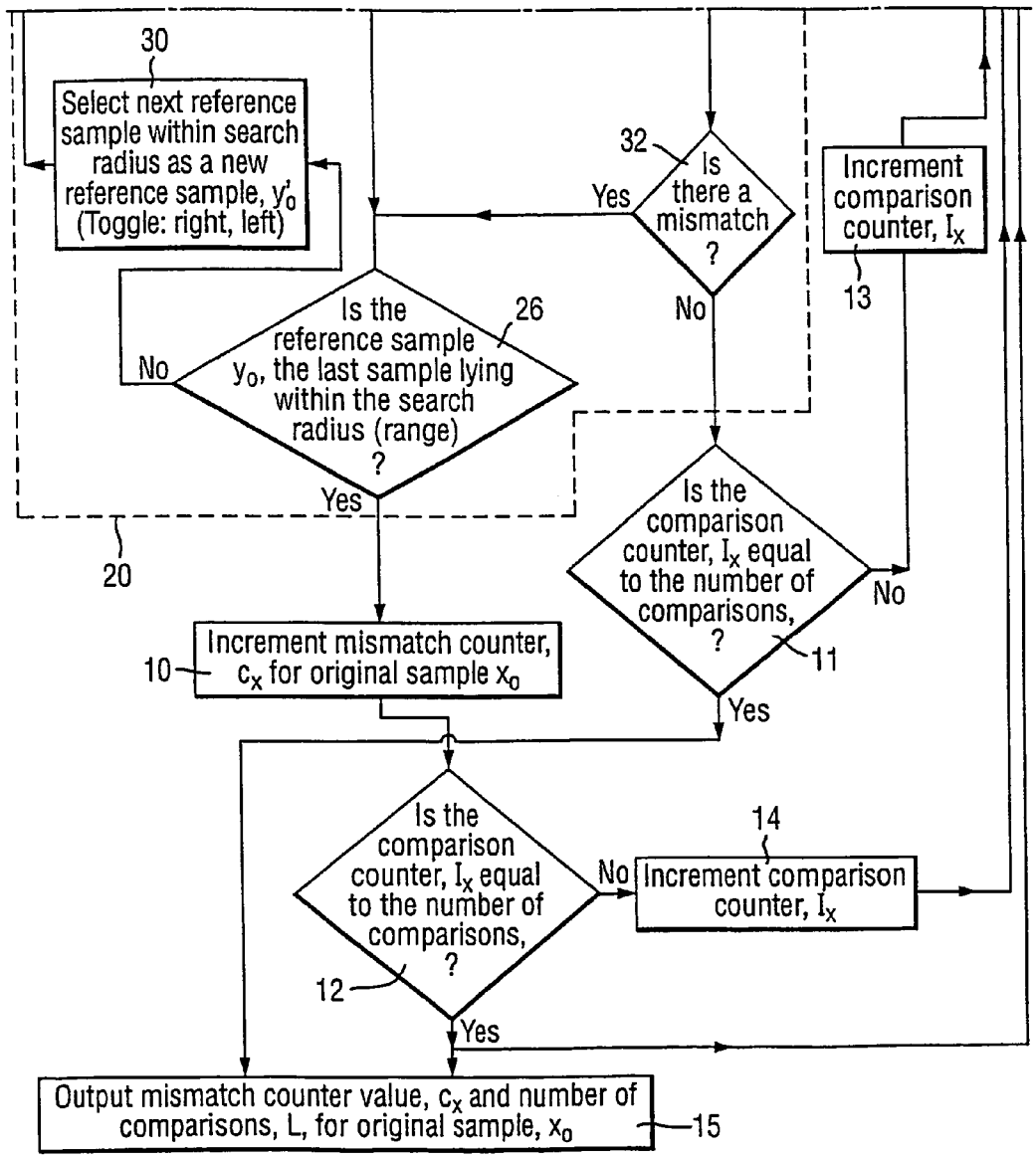
Figure 3A:
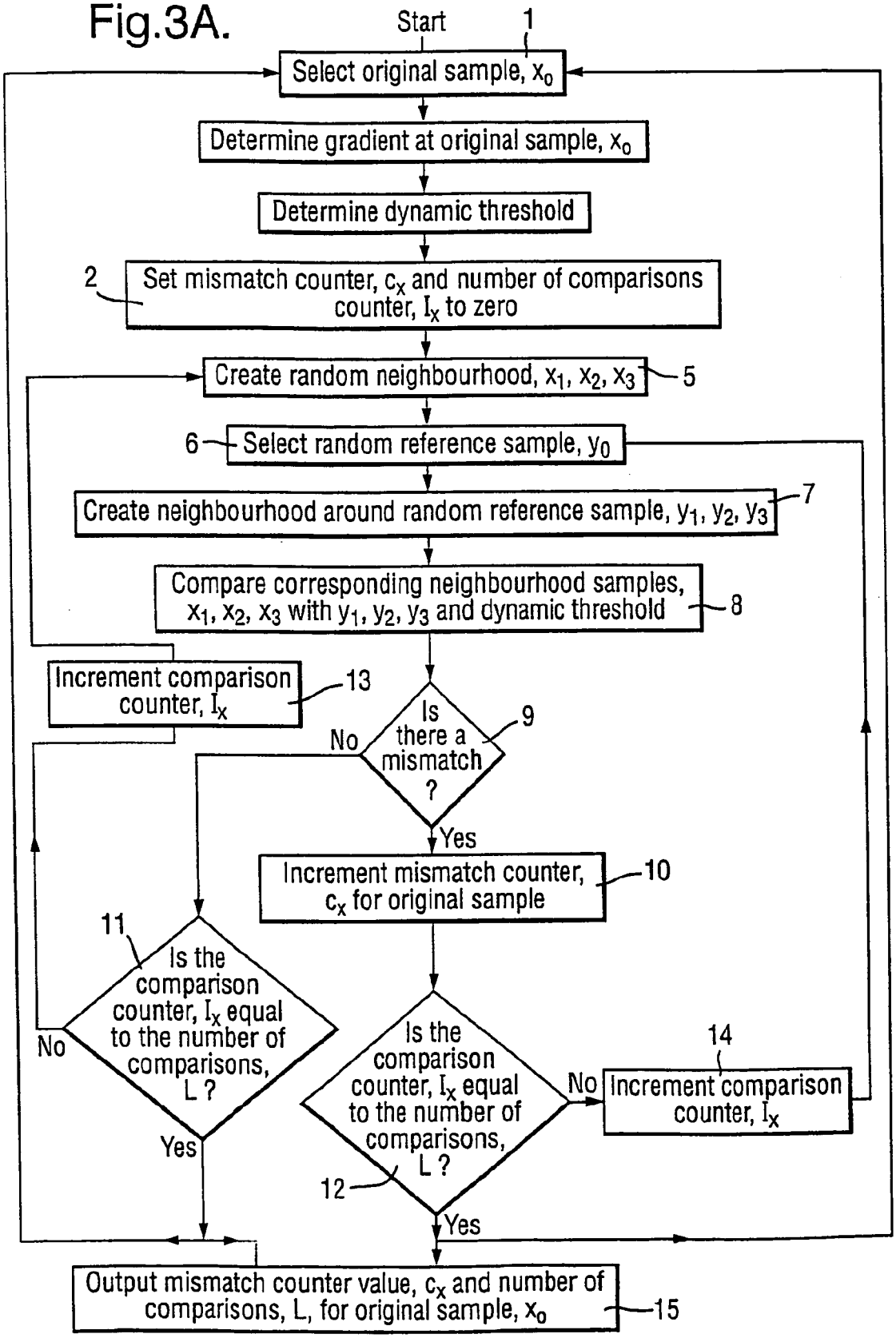
FIG. 3 is a flowchart which illustrates schematically the operation of a yet further embodiment of the invention.
Figure 3B:
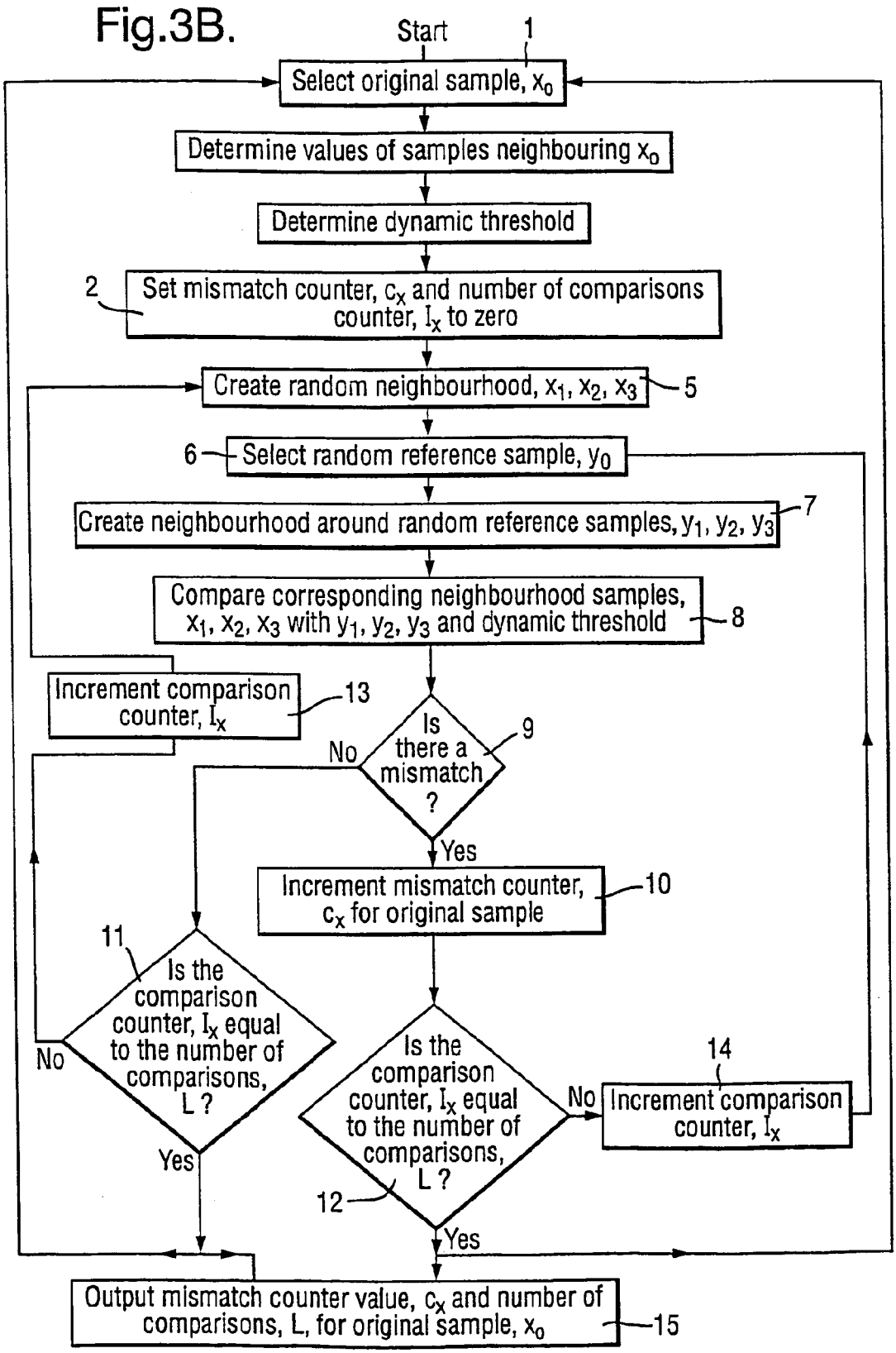

In the embodiments shown in FIGS. 1 and 3A and 3B, the values of the data in the original sample 'pattern' (test group), x0, x1, x2, x3 are then compared by calculation processor 26, with the values of the data in the reference sample 'pattern' (comparison group), y0, y1, y2, y3, defined by the reference sample together with its neighbouring samples (step 8). If the absolute value of the difference, |x0−y0|, |x1−y1|, etc, between two respective samples or elements is more than a certain threshold (PARAMETER: threshold), then it is considered as being 'different'. If one or more samples in the original sample pattern are different from the reference sample pattern, then it is said that a mismatch occurred. The choice of the threshold can optionally be varied, and may depend on the range of values within the set of data. In the embodiment shown in FIG. 2, this part of the algorithm is carried out according to similar principles but different values are compared. This is described below in more detail with reference to FIGS. 2 and 6.

In all other respects, however, the algorithm shown in FIG. 2 is the same as those shown in FIGS. 1 and 3A and 3B.

Further, with reference to FIGS. 1-5, when a mismatch occurs, the mismatch counter, cx, for the original sample, x0, is incremented (step 10). In this case the neighbourhood (test group) around the original sample (reference test element) is kept, i.e., the original sample pattern is kept, and the program returns to step 6 to choose another random $2^{nd}$ reference sample, y0, for the same comparison process.

When a match occurs the mismatch counter, cx, is not increased. The program returns to step 5 which creates a new neighbourhood around the original sample, whose configuration has a new pattern, before moving on to choose another random $2^{nd}$ reference sample (step 7) for the comparison step (step 8).

For each original sample, x0, a certain number of comparisons, L, are made which result in a certain number of mismatches and matches. The total number of mismatches plus matches is equal to the number of comparisons (step 11 and step 14). The number of comparisons can be varied and will depend on the data to be analysed and the processing power available. Also, the greater the number of comparisons, the greater the accuracy of the anomaly detection.

Once the comparison step (step 8) has been done the certain number of times, L, the program returns to step 1 to select a different original sample, x0 and the mismatch counter value, cx, and the number of comparisons, L, is output for original sample, x0 (step 15).

Whether the original sample or reference test element, x0, is judged to be an anomaly will depend on the number of mismatches in comparison to the number of comparisons, L. The normalised anomaly scores for each original sample, x0, are obtained by dividing the mismatch counter, cx, for each sample, x0, by the number of comparisons, L, which is also equal to the maximum mismatch count, so that the anomaly score ranges from zero to one, with zero being 0% mismatch and one being maximum mismatch.

Figure 5:
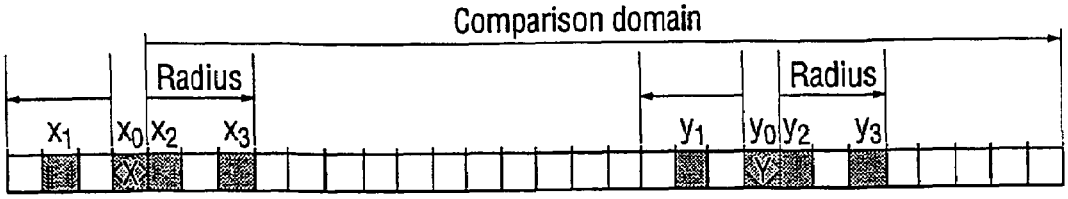
FIG. 5 shows an example of a comparison between original sample, x0 and random reference sample, y0.

FIG. 5 shows an example of a one-dimensional data with each box representing a sample. Sample marked 'x' is the original sample and sample marked 'y' is the randomly chosen reference sample. The samples, x1, x2, x3, are the neighbourhood samples whose configuration make up the original sample pattern. In the example shown in FIG. 5, the radius (or neighbourhood range) is equal to 3, the neighbourhood size is equal to 3 and the comparison domain is equal to the region where y is chosen. A mismatch occurs if |xn−yn|>threshold, where, n, the neighbourhood size takes a value from 1 to 3.

As shown in FIG. 5, the first sample which could be scored is the sample with a distance 'radius' away from the start and the last sample to be scored is the sample with a distance 'radius' away from the end.

By way of further explanation of the above example of comparison, a numerical example is set out in Table 1.

TABLE 1

Example of Comparison

| Sample Index, n | (normalizd) Value of $X_n$ | (normalizd) Value of $Y_n$ | Thresh-old value | Value of $\lvert Y_n - X_n \rvert$ | Mismatch? |
|---|---|---|---|---|---|
| 0 | 0.75 | 0.70 | 0.2 | 0.05 | No |
| 1 | −0.90 | −0.71 | 0.2 | 0.19 | No |
| 2 | 0.01 | 0.34 | 0.2 | 0.33 | YES |
| 3 | 0.23 | 0.45 | 0.2 | 0.22 | YES |

In the examples given, two of the samples mismatch. As long as one or more samples in the neighbourhood mismatches, the mismatch counter for the original, in this example, $X_0$, will be incremented by one.

Figure 6:
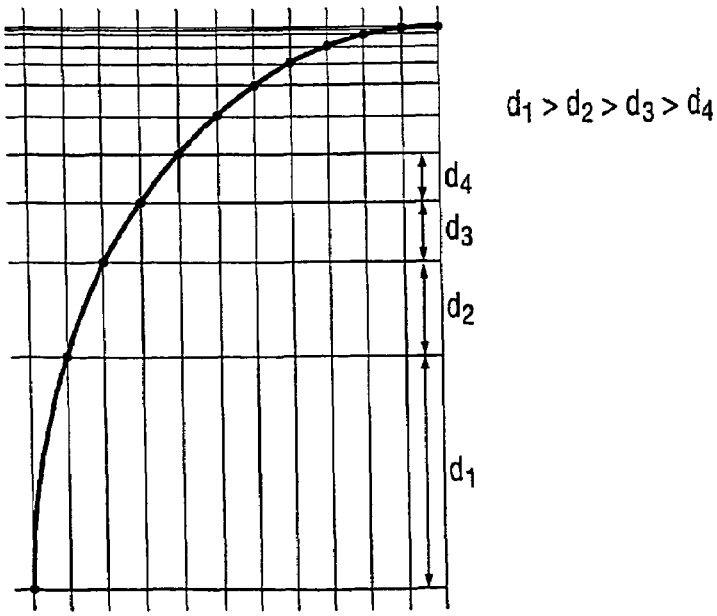
FIG. 6 shows the failure of a static threshold.

With reference to FIGS. 2 and 6, the inventor has noticed that when the waveform becomes complex or the sampling rate is increased the number of mismatches increases relative to the number of matches. This causes the scores to become saturated. As the complexity of the waveform increases the probability of picking a random reference Y sample that matches the original sample X decreases. Similarly, as the sampling rate is increased, the probability of finding a match decreases. The increased probability of having a mismatch causes saturation of the scores.

To alleviate the problem of score saturation, a 'hill climbing' strategy has been developed to improve the likelihood of a match. The strategy is called "hill climbing" because when a mismatch is found, the waveform is "climbed" in both directions along the ordered set of data elements until a match is found.

FIG. 2 is a flow diagram showing the steps an algorithm including the "hill climbing" process and how they fit in with the steps of the sample analysis algorithm described above. The hill climbing process is shown within the dotted line 20. It is seen in FIG. 2 that the 'hill climbing' process includes some additional steps to the sample analysis algorithm shown in FIG. 1.

The "hill climbing" process is explained with reference to FIGS. 2 and 6. First the original sample, marked X, is chosen (step 1). The neighbourhood samples, coloured medium dark grey in FIG. 8 and shown in the neighbourhood of the original sample X, are then selected either randomly (step 5) or reused from the previous comparison if a mismatch occurred previously (refer to step 6). In the example shown in FIG. 8, the neighbourhood size (parameter: neighbourhood size) is three, hence three neighbouring samples are selected. And the furthest distance from which a neighbouring sample can be selected is the radius (parameter: radius), which is equal to four in the example in FIG. 8. These samples make up the original "pattern" (step 5).

Figure 8:
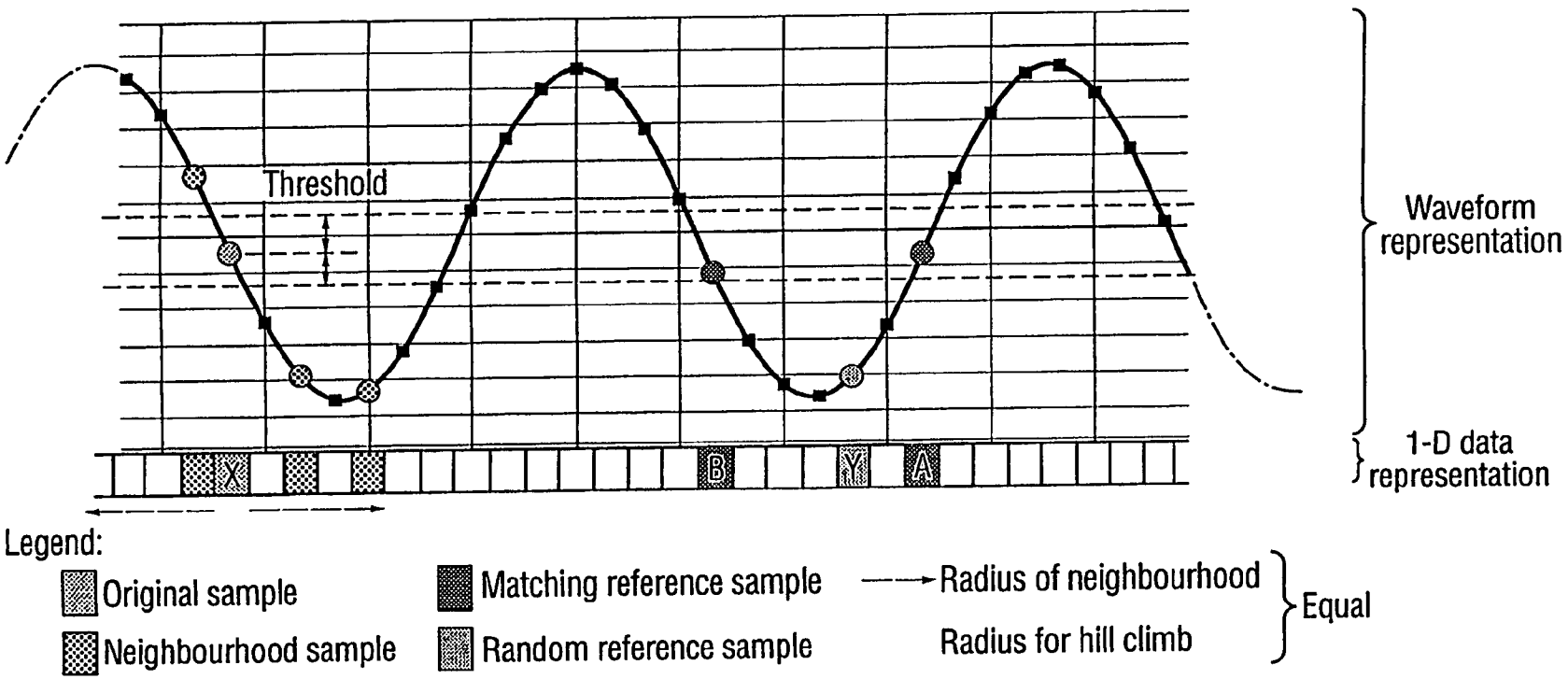
FIG. 8 shows an example of the "hill climbing" embodiment of the present invention.

Next, a reference sample, marked Y, is randomly chosen from anywhere in the data within a certain domain (step 6) (parameter: comparison domain, not shown in FIG. 8, but shown for example, in FIG. 5).

Then the reference sample, Y, is compared with the original sample, X (step 22). It is determined whether the is a mismatch between the reference sample and original sample (step 24). In the example shown in FIG. 8, the reference sample Y lies outside the threshold (parameter: threshold) region of the original sample X, hence it does not match the original sample X. Therefore, in the case of this mismatch the next step (steps 26, 28, 30 and 32) is to 'hill climb' the reference sample by searching the samples within a search radius around Y for a sample that matches with the original sample X. This searching is done one sample at a time in both directions along the one dimensional array (step 30).

In FIG. 8 the sample marked A is the first sample near sample Y that matches the original sample X as it falls within the threshold region. Next, the neighbourhood samples of X (coloured medium dark grey) are compared with the corresponding neighbourhood samples of A (step 28). If they match (step 32), then the mismatch counter is not increased and the process is continued with the next comparison by selecting another random reference sample (step 6). In the example shown in FIG. 8, the corresponding neighbourhood samples X and A do not match (step 32), but in spite of this and in contrast to the steps shown in FIG. 1, the mismatch counter for sample X is not increased.

Instead of increasing the mismatch counter, the 'hill climbing' process is continued as described above. Eventually, sample marked B is selected and found to match the original sample X. Then the neighbourhood samples of X (coloured medium dark grey) are compared with the corresponding neighbourhood samples of B (step 28).

If they match one another, then the next comparison is continued with by selecting another random reference sample (step 6). In the example shown in FIG. 8 they do match, so the mismatch counter is not increased, and the process is continued with the next comparison by selecting another random reference sample. It can be seen by reference to FIG. 8 and the explanation above, the 'hill climbing' process stops when one of two things happen. The process stops when the algorithm finds a matching "pattern". Alternatively, the other way the 'hill climbing' process stops is when the algorithm fails to find any matching "pattern" within a certain search radius for the 'hill climbing' (illustrated in FIG. 8). The radius being set to be equal to the radius of the original sample X's neighbourhood (parameter: radius). The algorithm searches all samples within the search radius (step 26). When the algorithm fails to find any matching "pattern" in the neighbourhood, then the mismatch counter for original sample X is increased (step 10).

Therefore, the mismatch counter for the original sample only increases when there is no matching pattern within the 'hill climbing' search radius from the randomly selected reference sample. By only increasing the mismatch counter when there are no matching "patterns" in the neighbourhood of the reference sample, the constraints imposed on the search for a match are relaxed. Thus, the probability of finding a match are increased. This process is successful in eliminating the problem of saturation of the scores observed by the inventors. Reference is made to FIGS. 10 to 15 which show the results achieved.

With reference to FIG. 6, the inventor has found, that in addition to the problem of saturation another problem exists. Due to the effects of constant sampling rate, samples which lie on a larger gradient are more distant apart compared to samples which lie on a small gradient.

This is because a constant sampling rate means samples are taken at equal intervals of time. When the waveform changes rapidly, i.e. has a large magnitude of gradient, the difference between two subsequent sample values is therefore large. When the waveform has a small gradient, there is only a slight difference between two subsequent sample values. See FIG. 6 for illustration.

The effect of a static threshold or mismatch criterion while comparing samples is as follows: samples which lie on the larger gradient will be discriminated and have high mismatch scores as they are less likely to match with their neighbours. This will result in an artificially high mismatch score for data lying on a steep gradient. Similarly, data lying on a shallow gradient will score too low.

The inventor has found that this detrimental effect can be removed by using a dynamic threshold, which takes into account the local gradient of the samples. The dynamic threshold is an adaptive variable threshold that is dependent on the sample's local gradient.

The dynamic threshold may be defined as:

$$DynamicThreshold = \frac{LocalGradient}{2} + StaticThreshold$$

In sampling an analogue waveform (see FIG. 2) discrete samples are taken over equal time intervals. Each sample acts as a representative for the particular interval. In this interval the waveform however assumes different values. The local gradient can be defined as the difference between the boundary values of the interval and is a measure of the variation in the interval (the intervals will be chosen smaller than any periodicity of the waveform). In this way, the sample interval is set to have a non-dimensional value of 1. By defining a dynamic threshold which increases with increasing local gradient, for example by adding a term proportional to the gradient as above to a static threshold value, the mismatch criterion is increased for steeper gradients and sampled values may thus differ more before they mismatch. For small gradients, samples are mismatched if they differ by a smaller threshold amount.

The mismatch criterion or threshold is thus adaptive to the particular environment of a sample. (PARAMETER: threshold). The static threshold can be determined to suit the particular data and sensitivity required. Similarly, the particular form of the gradient responsive term may vary according to the sampled data and could be determined empirically. (Obtaining a dynamic threshold is optional, and a static threshold is possible instead).

Figure 7:
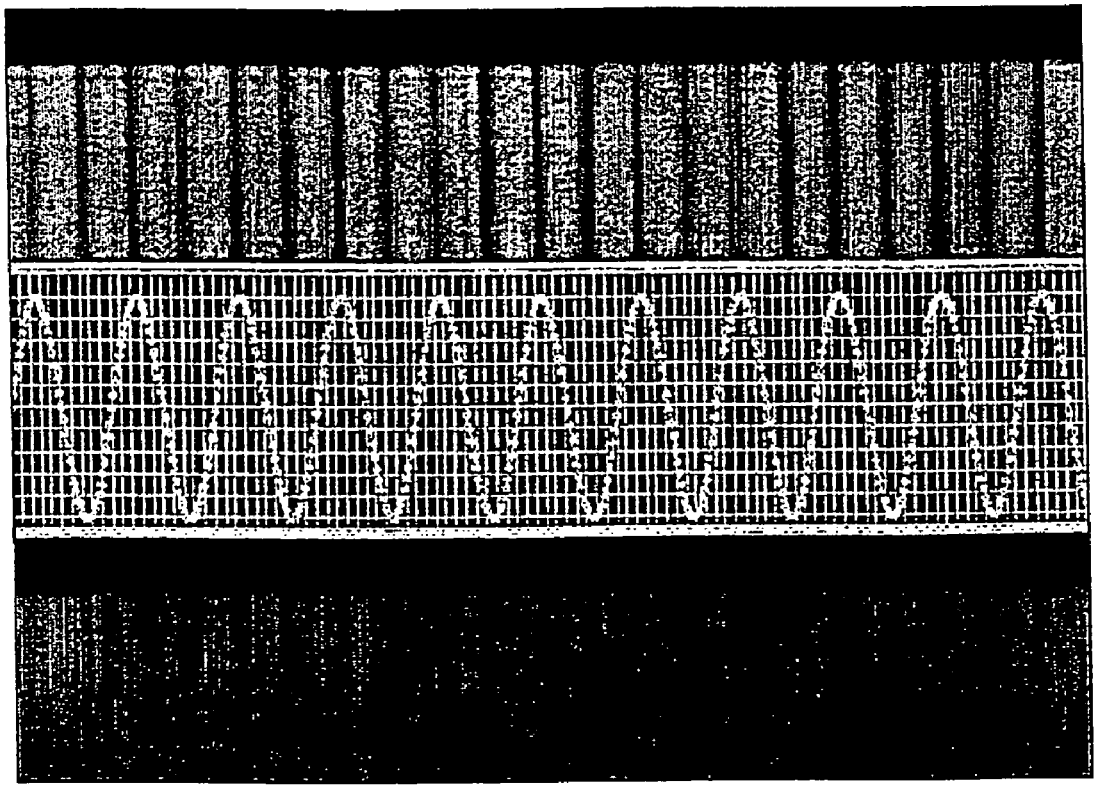
FIG. 7 shows a static threshold vs a dynamic threshold.

In FIG. 7, the upper spectrum shows the result with striations due to discrimination on large slopes using the static threshold while the spectrum below shows a more uniform attention score as a result of dynamic thresholding.

In the above example, the data comprises an analogue waveform which is sampled at regular intervals, although it will be appreciated that the intervals need not be regular.

FIG. 2 shows the steps taken in the case where an analogue waveform is sampled, and includes the step 3 of determining the gradient at the original sample, x0, and step 4 of determining the dynamic threshold. In step 8, the corresponding neighbourhood samples are compared with the dynamic threshold.

FIG. 3 shows the steps taken in the case of an array of digital data, and includes step 16 of determining the values of samples neighbouring the original sample, and step 17 determining, the dynamic threshold. In step 8, as for the case of an analogue waveform, the corresponding neighbourhood samples are compared with the dynamic threshold.

The gradient determination step and the step of determining the values of samples neighbouring the original sample are carried out by the calculation processor 26, and the values determined are stored in the register 259, where they are accessible as the dynamic threshold value for use in the comparison step (step 8).

Both the "hill climbing" process and the dynamic threshold process may be implemented independently to one another as shown in FIGS. 2, 3A and 3B. Alternatively, they may be implemented in combination with each other. In particular, the "hill climbing" process described above with reference to FIGS. 2 and 6 is suitable for combination with either of the dynamic threshold embodiments shown in FIGS. 3A and 38.

FIGS. 9 to 15 show Results 1 to 7, respectively. The results shown in these Figures are produced after the implementation to the sample analysis algorithm described with reference to FIGS. 1 and 5 of a combination of the "hill climbing" shown in FIGS. 2 and 6 and the dynamic threshold processes shown in FIGS. 3A and 3B described above.

The results show good anomaly discrimination with no saturation.

The comparison domain for these results is the entire data length. The results show in the lower part of the diagram the input data for analysis. The upper portion of the diagram shows the mismatch scores achieved for each sample using the sample analysis algorithm plus the "hill climbing" and dynamic threshold modifications. In the upper portion, an anomaly is identified as being those portions having the highest mismatch scores.

The results shown are for audio signals. However, the present invention may also be applied to any ordered set of data elements. The values of the data may be single values or may be multi-element values.

Result 1 shown in FIG. 9 shows a data stream of 500 elements having a binary sequence of zeros and ones. The anomaly to be detected is a one bit error at both ends of the data. In this example, the number of comparisons was 500, the radius was equal to 5, the neighbourhood size was equal to 4 and the threshold was equal to zero. The peaks in the upper portion of the graph show a perfect discrimination of the one bit errors at either end of the datane array.

Result 2 shown in FIG. 10 shows data stream having the form of a sine wave with a change in amplitude. In this example, the number of comparisons was 500. The radius was equal to 5, the neighbourhood size was equal to 4 and the threshold was equal to 0.01. The peaks in the upper portion of the graph show a perfect discrimination of the anomaly. The highest mismatch scores being for those portions of the data stream where the rate of change of amplitude is the greatest.

Result 3 shown in FIG. 11 shows a data stream having the form of a sine wave with background noise and burst and delay error. In this example, the number of comparisons was 500, the neighbourhood size was equal to 4 and the threshold was equal to 0.15. The peaks in the upper portion of the graph show a good discrimination of the anomalies present.

Figure 12:
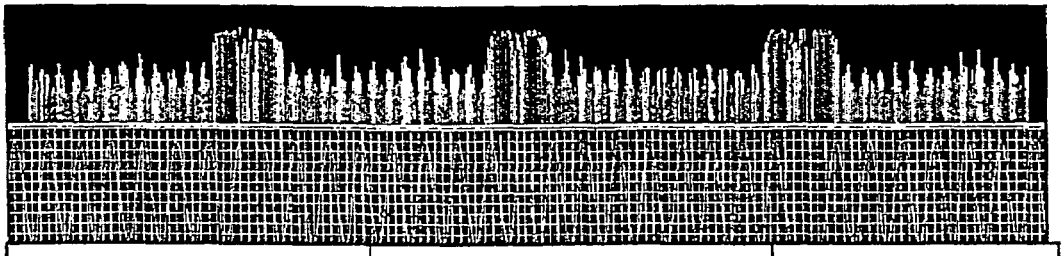
FIG. 12 shows Result 4.

Result 4 shown in FIG. 12 shows a data stream having the form of a 440 kHz sine wave that has been clipped. The data has been sampled at a rate of 22 kHz. In this example, the number of comparisons was 1000, the radius was equal to 75, the neighbourhood size was equal to 4 and the threshold was equal to 0.15. The peaks show a good discrimination of the anomalies. Further, it is commented that the gaps in between the peaks can be eliminated by selecting a larger neighbourhood size.

Figure 13:
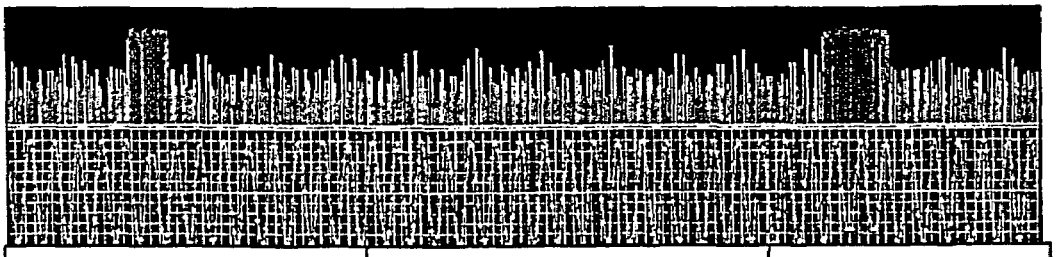
FIG. 13 shows Result 5.

Result 5 shown in FIG. 13 shows a data stream having the form of a 440 kHz sine wave that has been clipped. The data has been sampled at a rate of 11 kHz. In this example, the number of comparisons was 1000, the radius was equal to 10, the neighbourhood size was equal to 5 and the threshold was equal to 0.15. The peaks show a good discrimination of the anomalies.

Figure 14:
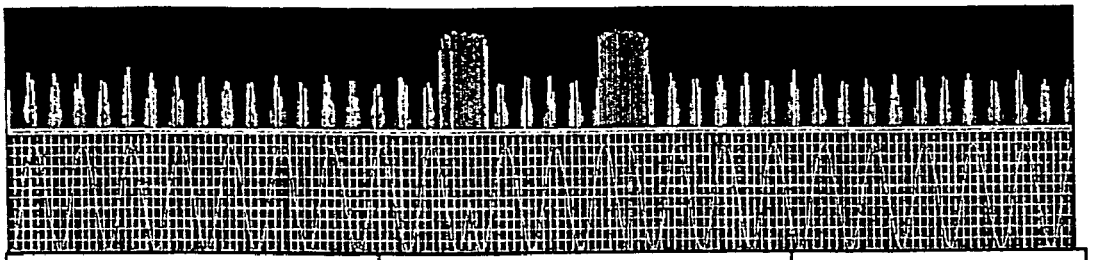
FIG. 14 shows Result 6.

Result 6 shown in FIG. 14 shows a data stream having the form of a 440 kHz sine wave including phase shifts. The data has been sampled at a rate of 44 kHz. In this example, the number of comparisons was 1000, the radius was equal to 50, the neighbourhood size was equal to 4 and the threshold was equal to 0.1. The peaks show good discrimination of the anomalies.

Figure 15:
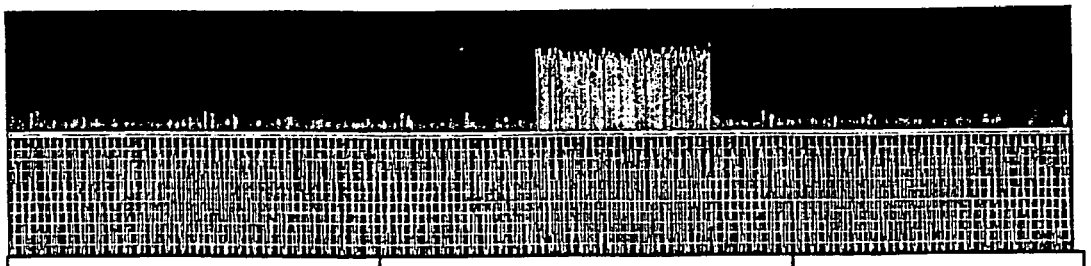
FIG. 15 shows Result 7.

Result 7 shown in FIG. 15 shows a data stream having the form of a 440 kHz sine wave including phase shifts. The data has been sampled at a rate of 44 kHz. In this example, the number of comparisons was 1000, the radius was equal to 50, the neighbourhood size was equal to 4 and the threshold was equal to 0.1. The peaks show near perfect discrimination of the anomalies.

An error correction system is now described with reference to FIGS. 16-20, which has application to the present invention. Having used the anomaly detection system previously described to identify regions of anomaly in a waveform, error correction is provided to remove the detected errors. From the attention map produced as described above, a suitable filter coefficient is set (PARAMETER: filter coefficient) so that only the anomalous region remains in the map before passing the data to an error correction algorithm.

The error correction algorithm used depends on the algorithm used to detect the anomaly. For example, a cycle comparison detection algorithm is described further below which is for use together with a cutting and replacing correction algorithm. It has been found that a shape learning error correction algorithm yields better results with the anomaly detection algorithm described above in this application. The shape learning algorithm is described below.

The shape learning error correction described below may be implemented directly. The success of the error correction however, is dependent primarily on being able to pinpoint the anomaly with confidence, which is the function of the detection algorithm.

Figure 16:
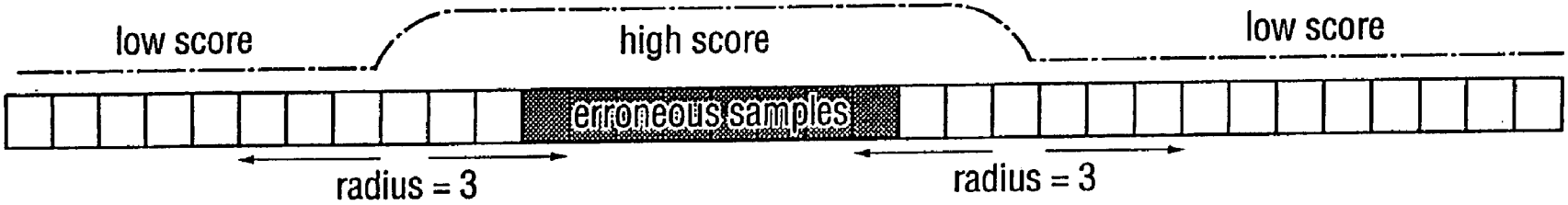
FIG. 16 shows an example of how the error correction algorithm identifies a high anomaly score region.

The error correction method described below deals with the error by taking a closer look at what is happening when the detection algorithm does the comparison described above. FIG. 16 shows that due to the nature of the detection algorithm, the first and last samples in a high score region are not amongst the erroneous samples. The first sample and last sample that have high score are a distance of 'radius' (PARAMETER: radius) away from the first and last erroneous sample. This is because the first neighbourhood that may select the erroneous sample as one of the neighbourhood samples normally lies a distance 'radius' away.

Figure 17:
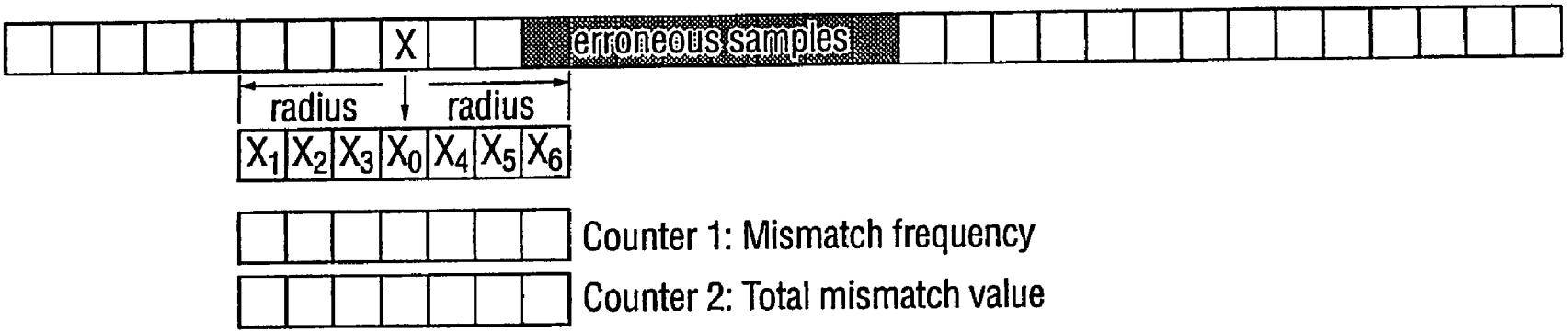
FIG. 17 shows an example of how the error correction algorithm creates counters.

To explain the details of how the algorithm works the example given in FIG. 16 is referred to. A region of anomaly is indicated with high scores but the actual samples that are erroneous have lower scores than the indicated samples. The algorithm does the error correction routine starting from the left-hand side towards the right-hand side. First, as shown in FIG. 17, it takes the first sample from the left with a high score and creates two counters for each sample within the radius of the first sample.

All samples, $X_0$ to $X_6$, are then compared with other parts of the data. This comparison method is similar to the detection algorithm and uses the two parameters from the detection algorithm, which are the number of comparisons (PARAMETER: number of comparisons) and the static threshold value (PARAMETER: threshold). X is considered as the original sample. This comparison method uses the dynamic thresholding that is used in the detection algorithm described above.

Figures 18, 19:
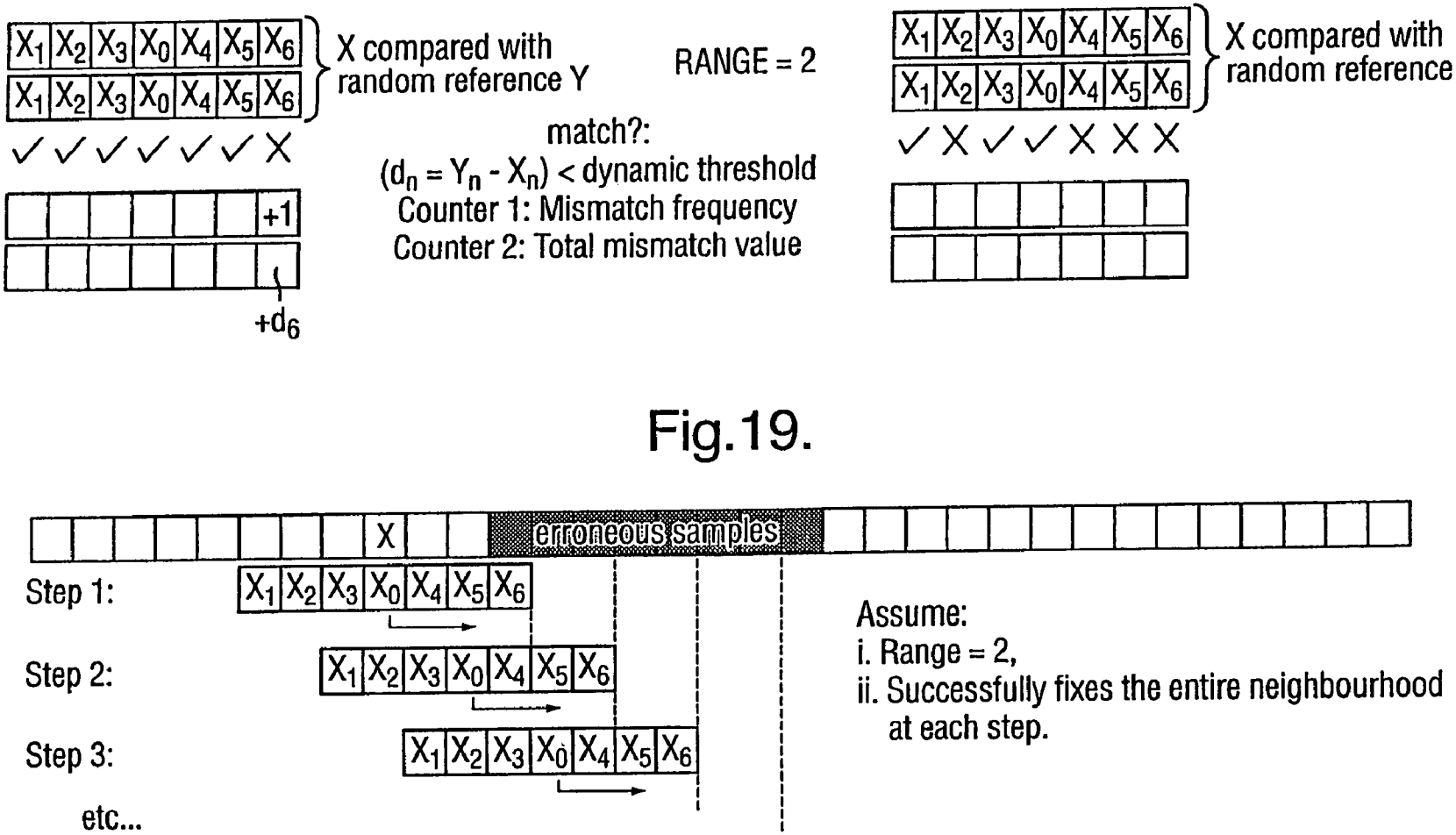
FIG. 18 shows an example of how the error correction algorithm carries out the comparison and logging process.
FIG. 19 shows an example of how the error correction algorithm moves a neighbourhood during error correction.

For each comparison of the neighbourhood, $X_0$ to $X_6$, with other parts of the data, if the number of samples in the neighbourhood that mismatches is less than or equal to a value called 'range' then certain information will be logged in the counters for those samples that mismatch, refer to FIG. 18. The value 'range' is given by the parameter "proportion to fix at one go" (PARAMETER: proportion to fix at one go) multiplied by the 'radius' (PARAMETER: radius) rounded to the nearest integer. The parameter proportion to fix at one go can take a value between 0 and 1. Hence the value 'range' takes a minimum value of 1 and maximum value of 'radius'.

Two examples are given in FIG. 18. When X and Y is compared, only one sample mismatches, which is less than the value of 'range'. So, the 'mismatch frequency' counter is increased for the sample(s) that mismatch and the 'total mismatch value' counter is also updated by adding it with the value of the difference between X and Y (the mismatch value). However, when X and Z is compared, four samples mismatch, which is more than the value of 'range'. If this happens, no information is logged. The counter values are not altered.

At the end of the comparison process, the 'mismatch frequency' counter holds the value indicating how often each of the samples $X_0$ to $X_6$ mismatches, and the 'total mismatch value' counter holds the sum of all the mismatch difference values that have occurred for each of the samples $X_0$ to $X_6$. From these two pieces of information, we can now decide which sample(s) are always causing a mismatch and how much to adjust them so that they will match more often. This can be done by first getting a mean value for the mismatch frequencies of all the samples. Then any sample(s) that have a larger mismatch frequency than the mean value will be considered needing adjustment. The amount to adjust each sample is given by the average value of the mismatch values. This average value is obtained by dividing the value in the 'total mismatch value' counter by the value in the 'mismatch frequency' counter of the sample(s) that need to be adjusted.

The sample(s) are then adjusted and the new attention score for the sample $X_0$ is obtained using the standard detection algorithm. If the new attention score is less than the previous score, the adjustments are kept, otherwise the adjustments are discarded. The algorithm repeats the process again for neighbourhood Xn and does the adjustments again as long as the attention score for $X_0$ decreases. If the attention score for $X_0$ does not decrease after a certain number of times (PARAMETER: number of tries to improve score) consecutively, the algorithm moves on the next sample to be chosen as the original sample. The next sample to be chosen lies 'range' number of samples to the right of the previous original sample. FIG. 19 illustrates how the algorithm uses the 'range' value as described above.

As shown in FIG. 19, for each new step the algorithm takes, the new original sample $X_0$ lies 'range' samples in front of the previous original sample. This also means that the new neighbourhood will contain 'range' number of erroneous samples, assuming that all the errors in the previous neighbourhood are corrected perfectly. Because of this, when the neighbourhood is compared to an identical reference neighbourhood elsewhere in the data, it is expected that only 'range' samples to mismatch while the rest of the samples should match. If more than 'range' samples mismatch, this means that the good samples are also mismatching, hence the reference neighbourhood that it compared with is unlikely to be identical to the original neighbourhood and therefore no information at all is logged.

Figure 21:
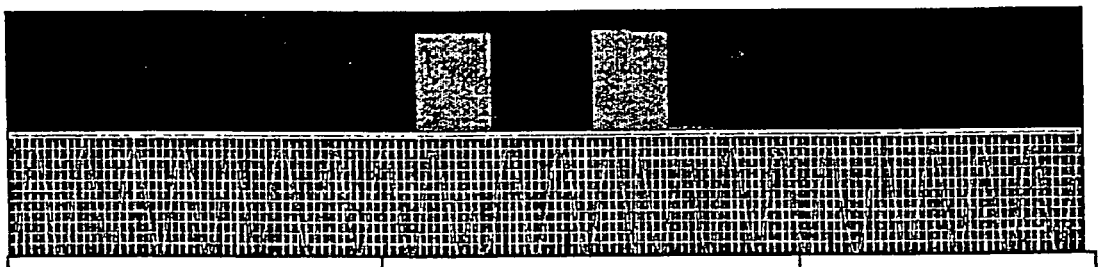
FIG. 21 shows Result 8.

The algorithm is called shape learning because it tries to make adjustments to the erroneous samples so that the overall shape or recurring pattern of the waveform is preserved. As the total number of samples is the same before and after the error correction, the algorithm works fine if the error is not best fixed by inserting or removing samples. If this is the case, then the algorithm will propagate the error along the waveform. This is due to the error correction routine which starts from the left of the 'high score' region and adjusts the samples towards the right. FIG. 21, Result 8 shows a good example of the phase shift error described above. In FIG. 21, the lower part of the diagram shows the input data for analysis. The upper portion of the diagram shows the results of the analysis where the y axis in the upper portion shows the mismatch value. In the upper portion, an anomaly is identified as being those (lighter) portions having the greatest mismatch values.

It is noted that Result 8 is shown to illustrate the phase shift. The error recognition has been achieved not using the algorithm described in this application, but using the cycle comparison algorithm described further below.

FIG. 20 shows a flow chart outlining the steps of the shape learning error correction described above.

Firstly, the first "high score" original sample, X, and its neighbourhood are obtained, step 100. Next, counters are created for each of the samples in the neighbourhood, step 102. A random reference sample and its neighbourhood are also selected, step 104. Having done this, the entire neighbourhood is compared, step 106, and it is determined whether more than the "range" of samples mismatch. If the answer is "yes", the comparison counter is increased, step 114, and the algorithm returns to step 104 to select a random reference sample and its neighbourhood. If the answer is "no", the next step is to obtain the difference, the mismatch value, dn, for the sample or samples that mismatch, step 108. Then the mismatch frequency counter is increased and the mismatch value, dn is added to the mismatch value counter for the sample or samples that mismatch, step 110.

Next, it is determined whether the comparison counter is equal to the number of comparisons, step 112. If the answer is "no" the algorithm returns to step 114, and the comparison counter is increased before the algorithm returns to step 104 to select a random reference sample and its neighbourhood. If the answer is "yes", the mean of the mismatch frequency counters is obtained, step 116. Subsequently, the sample or samples whose mismatch frequency counter is more than the calculated mean in step 116, are identified, step 118. The identified sample or samples are adjusted by their average mismatch value, step 120. Having done this, a new attention (mismatch) score is obtained for the original sample using the sample analysis detection algorithm described above, step 122. The new attention (mismatch) score is compared with the old (first) attention score, step 124. If it is lower than the old score, the adjustments made are kept and the failed counter is reset. If the new score is not lower, the adjustments made are discarded and the failed counter is increase, step 126.

Next, it is determined whether the failed counter is equal to the number of tries to fix the error, step 130. If the answer is "no", the algorithm returns to step 104 to select a random reference sample and its neighbourhood. If the answer is "yes", the next original sample, X, and it neighbourhood is obtained, step 132, before the algorithm returns to step 102, to create counters for each of the samples in the neighbourhood.

Depending on the type of error and the original waveform, certain methods could prove to be more efficient in removing the error. The shape learning algorithm described above, requires large amounts of processing time due to its looping construct. But nevertheless it is the preferred way of removing the error as it possesses the ability to predict the shape of the waveform. However, on occasion it propagates certain errors as it does not alter the total number of samples. Cutting or replacing as described in our copending unpublished application (IPD reference A30176) proves to be the best method in such cases. Further, it is noted that in any case the performance of the error correction is dependent on the performance of the anomaly detection algorithm.

A detection algorithm of the present invention has been demonstrated to be very tolerant to the type of input data as well as being very flexible in spotting anomalies in one-dimensional data. Therefore there are many applications where such detection method may be useful.

In the audio field, such a detection algorithm may be used as a line monitor to monitor recordings and playback for unwanted noise as well as being able to remove it. It may also be useful in the medical field as an automatic monitor for signals from a cardiogram or encephalogram of a patient. Apart from monitoring human signals, it may also be used to monitor engine noise. Like monitoring in humans, the output from machines, be it acoustic signals or electrical signals, deviate from its normal operating pattern as the machine's operating conditions vary, and in particular, as the machine approaches failure.

The algorithm may also be applied to seismological or other geological data and data related to the operation of telecommunications systems, such as a log of accesses or attempted accesses to a firewall.

As the detection algorithm is able to give a much earlier warning in the case of systems that are in the process of failing, in addition to monitoring and removing errors, it may also be used as a predictor. This aspect has application for example, in monitoring and predicting traffic patterns.

A further embodiment, the referred to as the "cycle comparison" is now described.

Detection of anomalies in an ordered set of data concerns instructing a computer to identify and detect irregularities in the set. There are various reasons why a particular region can be considered as 'irregular' or 'odd'. It could be due to its odd shape or values when compared with the population data; it could be due to misplacement of a certain pattern in a set of ordered pattern. Put more simply, an anomaly or irregularity, is any region which is considered different due to its low occurrence within the data.

In the specific examples given in the description of the invention, the algorithms are tested mainly on sampled audio data with the discrete samples as the one-dimensional data. However, the invention is limited in no way to audio data and may include, as mentioned above other data, or generally data obtained from an acoustic source, such as engine noise or cardiogram data.

This algorithm of the present invention works on the basis of identifying and comparing cycles delimited by positive zero crossings that occur in the set of data. The inventors have found however, that the sample analysis algorithm as described above may start to fail when the input waveform becomes too complex. Although the 'hill climbing' method described above has been implemented, saturation is still occurs for more complex waveforms. Saturation is an effect observed by the inventors when waveforms become complex or the sampling rate is increased. In these circumstances, the number of mismatches increases relative to the number of matches without necessarily indicating an anomaly. As the complexity of the waveform increases the probability of picking a random reference Y sample that matches the original sample X decreases. Similarly, as the sampling rate is increased, the probability of finding a match decreases. The increased probability of having a mismatch causes saturation of the scores.

Also, using the "hill climbing" method the processing time required to analyse a 1 s length of audio data sampled at 44 kHz sampling rate uses a lot of processing time, requiring up to 220 s of processing time on a PII266 MHz machine.

The method for the cycle comparison algorithm will now be described with reference to FIGS. 22 to 28.

Figure 22:
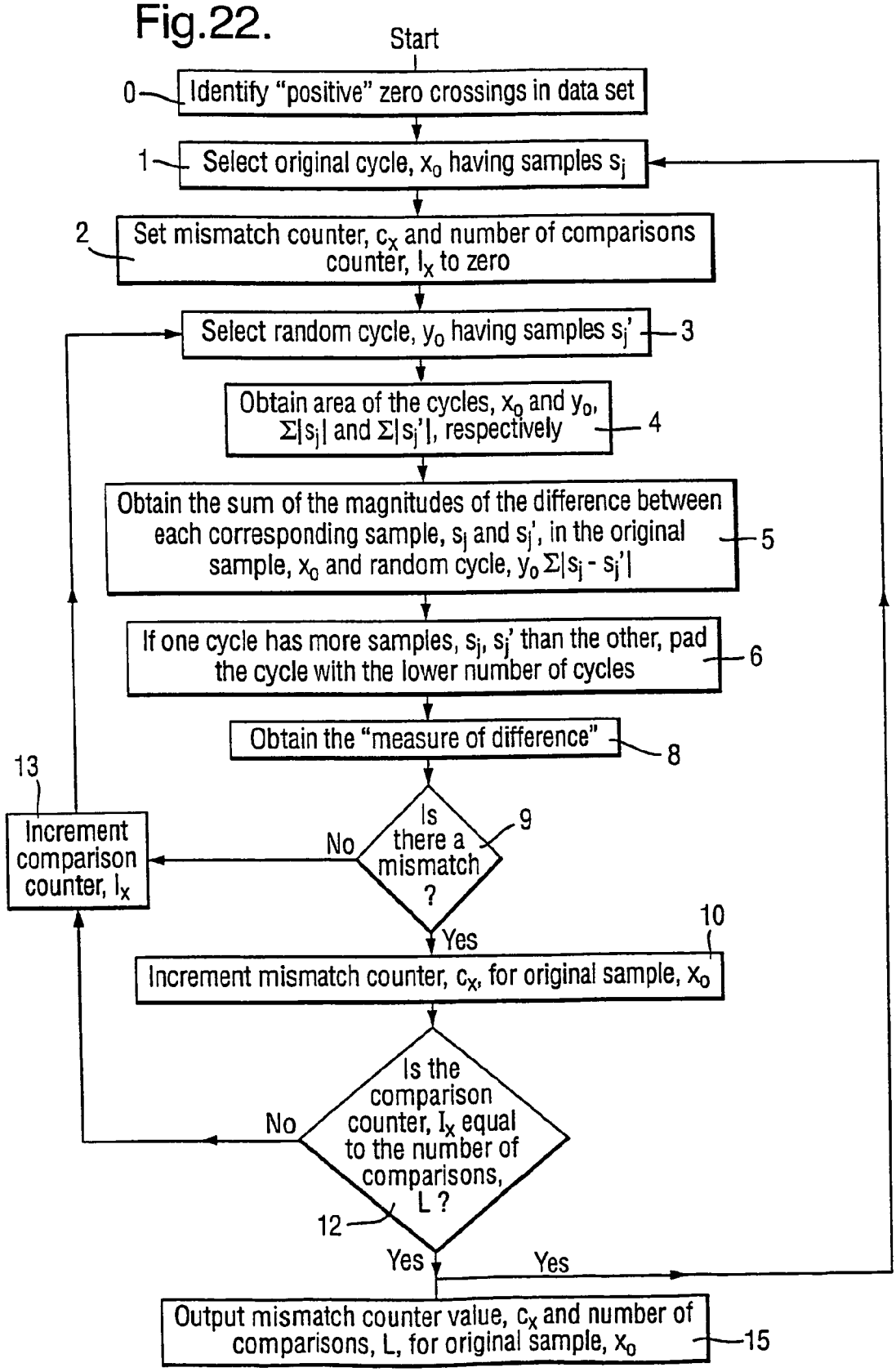
FIG. 22 is a flowchart which illustrates schematically the operation of an embodiment of the invention.
Figure 23:
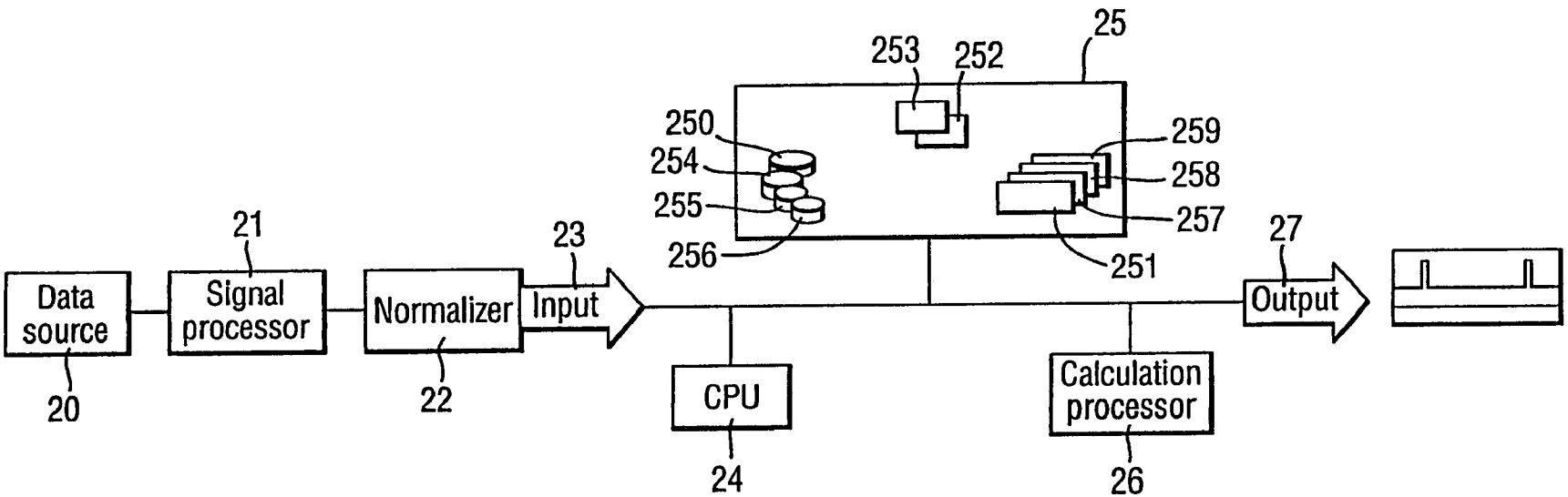
FIG. 23 illustrates schematically the basic components of a general purpose computer capable of performing the invention.

The components shown in FIG. 22 include a data source 20 and a signal processor 21 for processing the data, a normaliser 22 and an input 23. The data is either generated or preprocessed using Cool Edit Pro—version 1.2: Cool Edit Pro is copyrighted© 1997-1998 by Syntrillium software Corporation. Portions of Cool Edit Pro are copyrighted© 1997, Massachusetts Institute of Technology. The invention is not limited in this respect, however, and is suitable for data generated or preprocessed using other techniques.

Also shown in FIG. 2 is a central processing unit (CPU) 24, an output unit 27 such as a visual display unit (VDU) or printer, a memory 25 and a calculation processor 26. The memory 25 includes stores 250, 254-256, registers 251, 257-259 and a mismatch counter 253 and a comparison counter 252. The data and the programs for controlling the computer are stored in the memory 25. The CPU 24 controls the functioning of the computer using this information.

With reference to FIGS. 22-28 where indicated, a data stream to be analysed is received at the input means 23. Firstly, the data is normalised by normaliser 22 by dividing all values by the maximum value of the data so that the possible values of the data range from −1 to 1.

The normalised data is stored in a digital form in a data store 250, as a one dimensional array, where each datum has a value attributed to it.

Then the algorithm identifies all the positive zero crossings in the waveform (step 0). A mean DC level adjustment (not shown) may also be made before the positive zero crossings are identified, to accommodate any unwanted DC biasing.

The positive zero crossings are those samples whose values are closest to zero and if a line were drawn between whose neighbours, the gradient of the line would be positive. For example, of the sequence of elements having the following values: −1, −0.5, 0.2, 0.8, 1, 0.7, 0.3, −0.2, −0.9, −0.5, −0.1, 0.4, the positive zero crossings would be 0.2 and −0.1.

Figure 24:
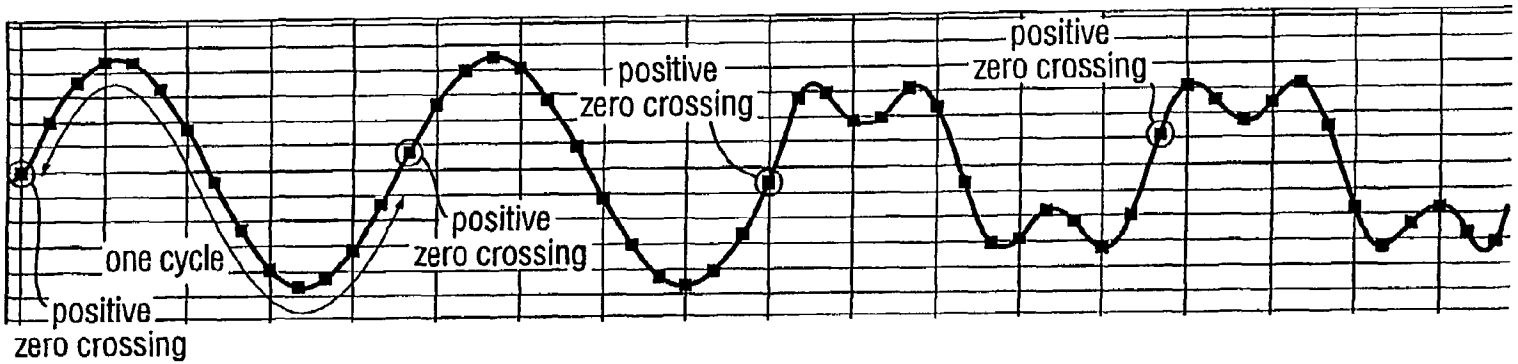
FIG. 24 shows an example of a waveform with cycles.

FIG. 24 shows a waveform with the positive zero crossings highlighted.

They may not always lie on the zero line due to their sampling position. The samples which is closest to the zero line, in other words have the smallest absolute value, are always chosen. A full cycle, as shown for example in FIG. 24, is made up of the samples lying between two consecutive positive zero crossings.

In the example shown the cycles are delimited with respect to the positive zero crossing. However, the cycles are not limited in this respect and may be delimited with respect to other criteria, such as negative zero crossings, peak values, etc. The only limitation is that preferably, both the test cycle and the reference cycle are selected according to the same criteria.

With reference to FIG. 22, the next step (step 1) is to choose a cycle beginning from the start of the data, to be the original cycle, x0. The values of the data of the samples in the original cycle, x0, are stored in the original cycle register 251.

A mismatch count, cx, stored in a mismatch counter 253, and a count of the number of data comparisons, Ix, stored in a comparison counter 252, are both set to zero (step 2).

The next step (step 3) is to randomly pick another cycle, y0, elsewhere in the waveform, within a certain domain (parameter: comparison domain), to be the comparing reference cycle. Usually, the original cycle and the reference cycle would come from data having the same origin. However, the invention is not limited in this respect. For the cases where the waveform has a form where the comparison domain may be large, for example, waveforms, for example derived from a running engine, which do not vary dramatically over time, the algorithm may be used to compare a test cycle from data from one source with a reference cycle from a second source. For cases, where the comparison domain may not be too large, for example, musical data which varies greatly over a short period of time, comparing a test source with a second reference source of data may not be so satisfactory. Reference is made to Result 10a shown in FIG. 38.

Figure 25:
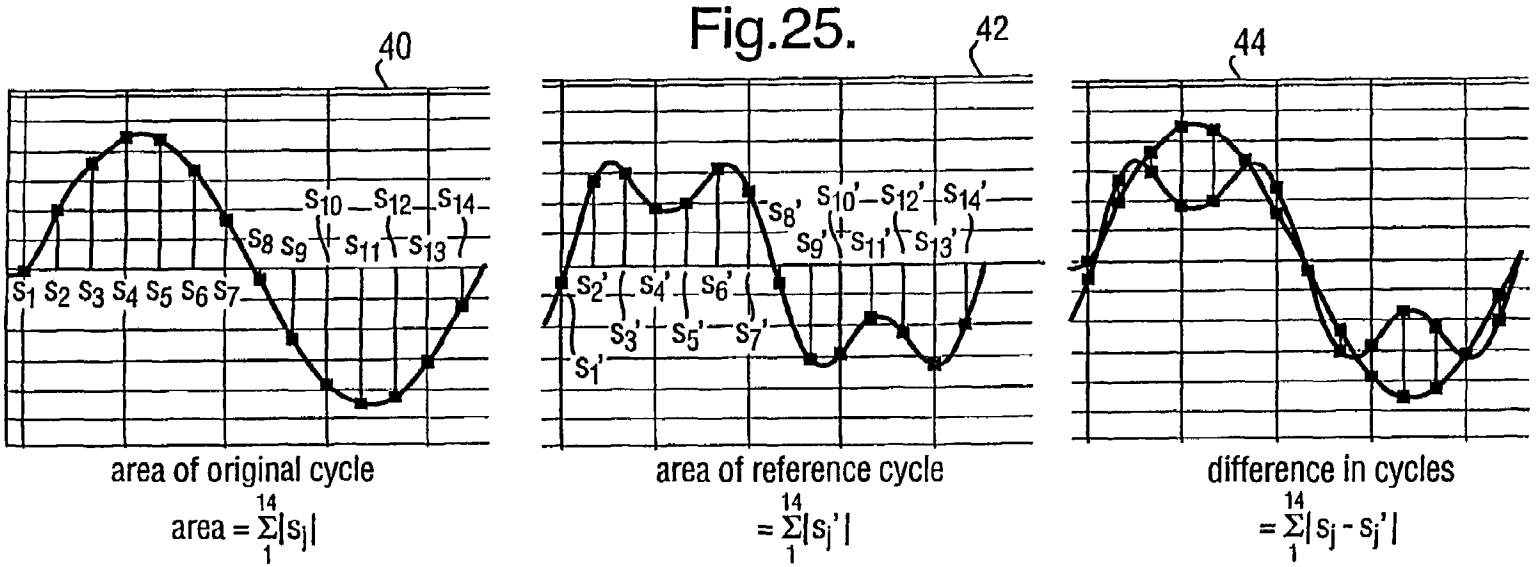
FIG. 25 shows area definitions of the cycles.

Returning to FIG. 22, the test cycle and the comparison cycle are then compared (steps 4, 5, 6, 7, 8) in order to obtain a mismatch score for the reference cycle, y0, with respect to the original cycle, x0. As seen in FIGS. 24 and 25, each cycle, x0, y0 includes a plurality of data samples or elements each having a value, sj, sj', respectively. Each value having also a respective magnitude.

The comparison of the cycles includes a series of steps and involves determining various quantities derived from the data in the cycles. The calculation processor 26 carries out a series of calculations. The derived quantities are stored in registers 257, 258 and 259. Firstly, an integration value is obtained for the original cycle and the reference cycle. This, may for example, be the area of the original cycle, sigma |sj|, and the area of the reference cycle, sigma |sj'| (step 4). With reference to FIG. 25, the area of a cycle is defined by the sum of the magnitudes of the individual samples in the cycle. Due to the definition of the area, which is the sum of the samples in the cycle, the area of identical cycles may vary to a great extent if the sampling rate is low and the waveform frequency is large. Hence, while using the cycle comparison algorithm, it is preferable to use at least 11 kHz sampling frequency for acceptable accuracy and sensitivity.

With reference to FIG. 25, which shows an example, the next step (step 5 ) is to derive a quantity which gives an indication of the extent of the difference between the area and the shape of the reference cycle, y0, with respect to the original cycle, x0. This is defined by the sum of the magnitudes of the difference between each of the corresponding samples in the original cycle and the reference cycle, sigma (|sj-sj'|). FIG. 4 shows three graphs. The first graph 40 shows the original cycle, x0, having samples, sj, having values s1 to s14. The area of the original cycle is equal the sum of the magnitudes of the values, s1 to s14: that being sigma |sj|. The second graph 42 shows the reference cycle, y0, having samples, sj', having values s1' to s14'. The area of the reference cycle is equal to the sum of the magnitudes of the values, s1' to s14': that being sigma |sj'|. The third graph 44 shows the difference the cycles as defined by sigma (|sj−sj'|).

The next step (step 6) is to establish whether both cycles have the same number of samples, sj, sj'. If the number of samples in the cycles are not equal, the shorter cycle is padded with samples of value zero until both the original and reference cycles contain the same amount of samples.

Figure 26:
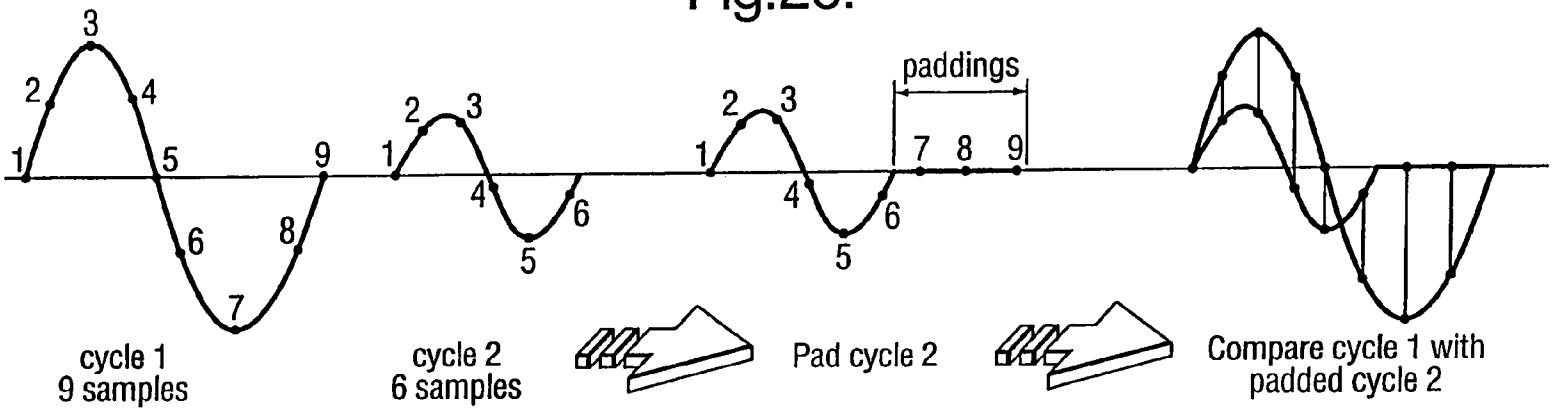
FIG. 26 shows an example of padding a cycle.

FIG. 5 shows an example of the padding described above with respect to step 6 shown in FIG. 1. In FIG. 26, cycle 1 has nine samples while cycle 2 only has 6 samples. In order to do a comparison, both cycles are made equal in sample size. This is achieved by padding the cycle having the fewer number of samples. In the example shown in FIG. 26, cycle 2 is padded with additional samples of value zero until it becomes the same size as the larger cycle, cycle 1 in this case.

The quantities derived in the steps described above are used to determine for each comparison of an original cycle with a reference cycle a "measure of difference" (step 8), which is a quantity that shows how different one cycle is from the other.

This empirical 'measure of difference' is defined as:

$$MeasureofDifference = \frac{AreaDifference}{LargerAreaOfTwoCycles + |MaxArea - MinArea|}$$

MaxArea is the largest area of a cycle in the entire comparison domain and MiniArea is the smallest area of a cycle in the entire comparison domain. LargerAreaOfTwoCycles is the bigger area of the original cycle and the reference cycle.

The inventors have derived the definition of the "measure of difference" as shown above for the following reasons.

Figure 27:
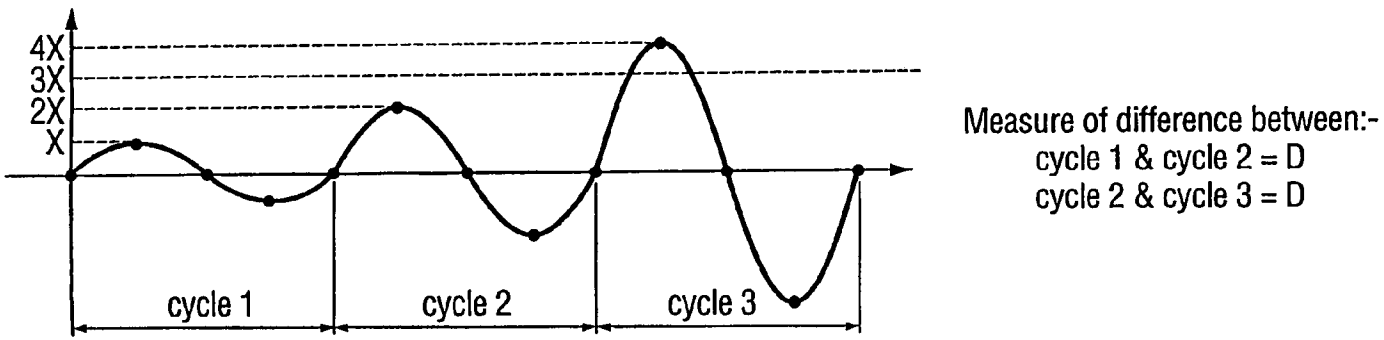
FIG. 27 shows the Measure of Difference using a first denominator—the Larger Area Of Two Cycles.

With reference to FIG. 27, the first denominator, LargerAreaOfTwoCycles, is neutral to logarithmic increments of the cycle amplitude. This means that every time a cycle is compared against another geometrically similar cycle which is double its amplitude, the measure of difference is the same. For example when a sine cycle of amplitude 'X' is compared with another sine cycle of amplitude '2×', the measure of difference is 'D'. Hence when a sine cycle of amplitude 'X' is compared with another sine cycle of amplitude '½X', the measure of difference would still be 'D'.

Figure 28:
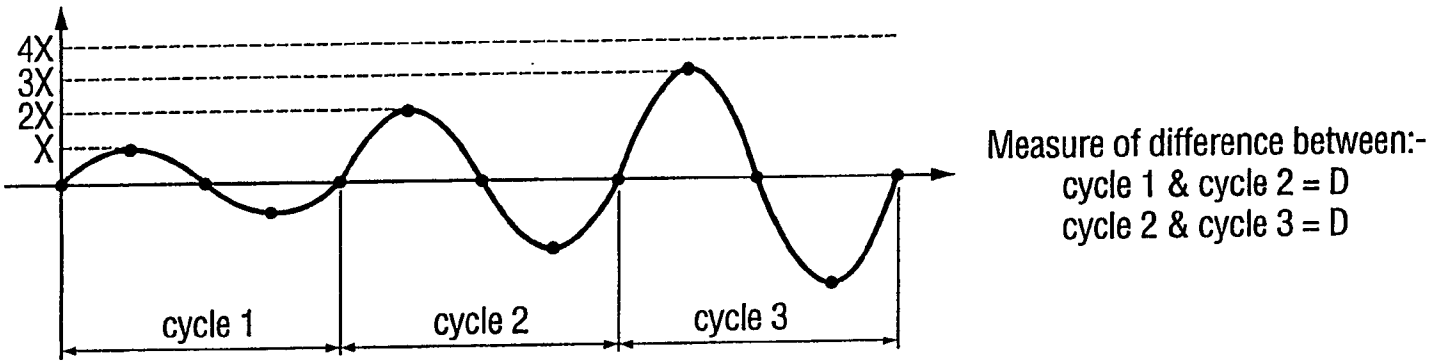
FIG. 28 shows the Measure of Difference using a second denominator—|MaxArea-MinArea|

Further, with reference to FIG. 28, the second denominator, |MaxArea−MinArea|, is a normalizing term for the quantity AreaDifference which is neutral to linear increments of the cycle amplitude. This means that if the amplitude of a geometrically similar cycle increases linearly, when a cycle is compared to the cycle next to itself, either left or right, both comparisons should give the same magnitude in the 'measure of difference'.

Either of these denominators may be chosen. It is not necessary to use both. However, if either of these denominations are used, it has been found that some desirable results as well as some undesirable ones occur. One of the denominators tends to be more effective on certain waveforms than the other. Therefore, preferably, a hybrid denominator made by adding them together is chosen, as this results in a much more general and unbiased 'measure of difference' which is effective independent of the waveform.

The derived 'measure of difference' is next compared with a threshold value (step 9) to determine whether there is a mismatch. If the calculated "measure of differences" for the original sample, x0, and the reference sample, y0, more than a certain threshold (PARAMETER: threshold), then it is considered as being 'different'. The choice of the threshold can be varied, and will depend on the range of values within the set of data.

Further, with reference to FIG. 22, when a mismatch occurs, the mismatch counter, cx, for the original sample, x0, is incremented (step 10). When a match occurs the mismatch counter, cx, is not increased. The program returns to step 3 which creates a new random reference cycle, y1, before moving on to calculate the quantities described above in steps 4 and 5, and carrying out any necessary padding in step 6, before calculating the "measure of difference" in step 8.

For each original sample, x0, a certain number of comparisons, L, are made which result in a certain number of mismatches and matches. The total number of mismatches plus matches is equal to the number of comparisons (step 11 and step 14). The number of comparisons can be varied and will depend on the data to be analysed and the processing power available. Also, the greater the number of comparisons, the greater the accuracy of the anomaly detection.

Each original cycle, x0, is compared with a certain number of reference samples, y0. The comparison steps from selecting a reference sample (step 3) to calculating the "measure of difference" (step 8) is carried out over a certain number of times (parameter: comparisons) Once the "measure of difference" (step 8) has been calculated for the certain number of reference samples, yL, and the comparison done the certain number of times, L, the program returns to step 1 to select a different original sample, x1 and the mismatch counter value, cx, and the number of comparisons, L, is output for original sample, x0 (step 15).

Whether original sample, x0, is judged to be an anomaly will depend on the number of mismatches in comparison to the number of comparisons, L. The normalised anomaly scores for each original sample, x0, are obtained by dividing the mismatch counter, cx, for each sample, x0, by the number of comparisons, L, which is also equal to the maximum mismatch count, so that the anomaly score ranges from zero to one, with zero being 0% mismatch and one being maximum mismatch.

FIGS. 24 to 39 show results obtained using the cycle comparison algorithm. With reference to our copending unpublished patent applications IPD ref A30114, A30174 and A30175, it is noted that the cycle comparison algorithm does not require parameter radius and parameter neighbourhood size.

The Results show good anomaly discrimination with no saturation.

If the comparison domain is unspecified, it is assumed to be the entire data length. The results show in the lower part of the diagram the input data for analysis. The upper portion of the diagram shows the mismatch scores achieved for each sample using the cycle analysis algorithm described above with reference to FIGS. 22 to 28. In the upper portion, an anomaly is identified as being those portions having the highest mismatch scores.

The results shown are for audio signals. However, the present invention may also be applied to any ordered set of data elements. The values of the data may be single values or may be multi-element values.

Figure 29:
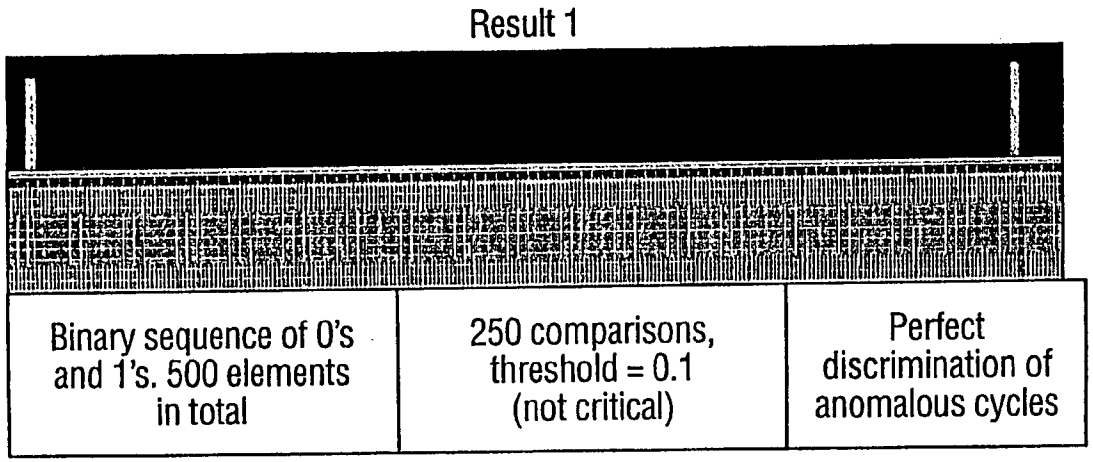

Result 1a shown in FIG. 29 shows a data stream of 500 elements having a binary sequence of zeros and ones. The anomaly to be detected is a one bit error at both ends of the data. In this example, the number of comparisons was 500, and the threshold was equal to 0.1. However, the choice of the threshold value in this case was not critical. The peaks in the upper portion of the graph show a perfect discrimination of the one bit errors at either end of the data sequence.

Result 2a shown in FIG. 30 shows data stream having the form of a sine wave with a change in amplitude. In this example, the number of comparisons was 250 and the threshold was equal to 0.01. However, the choice of the threshold value in this case was not critical. The peaks in the upper portion of the graph show a perfect discrimination of the anomaly. The highest mismatch scores being for those portions of the data stream where the rate of change of amplitude is the greatest.

Result 3a shown in FIG. 31 shows a data stream having the form of a sine wave with background noise and burst and delay error. In this example, the number of comparisons was 250, and the threshold was equal to 0.15. The peaks in the upper portion of the graph show a perfect discrimination of the anomalous cycles.

Result 4a shown in FIG. 32 shows a data stream having the form of a 440 kHz sine wave that has been clipped. The data has been sampled at a rate of 22 kHz. In this example, the number of comparisons was 250, and the threshold was equal to 0.15. The peaks show a perfect discrimination of the anomalous cycles.

Figure 33:
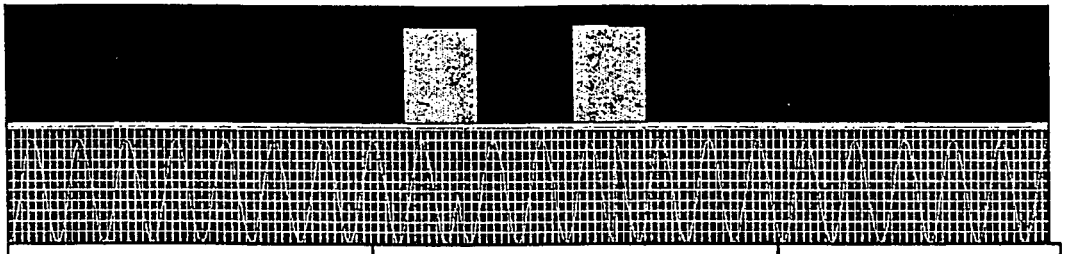

Result 5a shown in FIG. 33 shows a data stream having the form of a 440 kHz sine wave including phase shifts. The data has been sampled at a rate of 44 kHz. In this example, the number of comparisons was 250 and the threshold was equal to 0.15. The peaks show a perfect discrimination of the anomalies.

Figure 34:
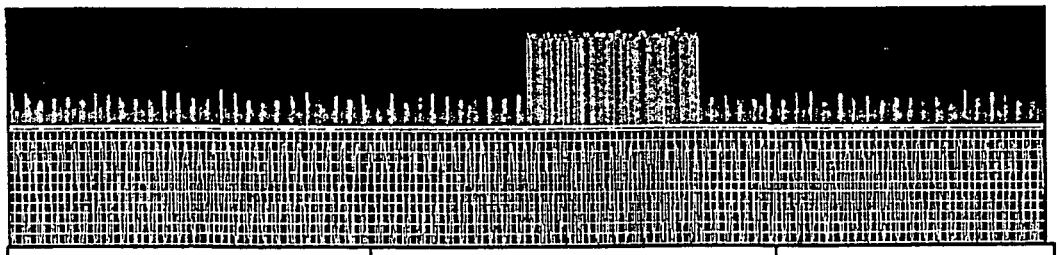

Result 6a shown in FIG. 34 shows a data stream having the form of a 440 kHz sine wave that has been clipped. The data has been sampled at a rate of 44 kHz. In this example, the number of comparisons was 250, and the threshold was equal to 0.15. The peaks show a near perfect discrimination of the anomalous cycles.

Result 7a shown in FIG. 35 shows a data stream having the form of a 440 kHz sine wave that has been clipped. The data has been sampled at a rate of 11 kHz. In this example, the number of comparisons was 250 and the threshold was equal to 0.05. In this example, the threshold value is critical as due to the low sampling rate. As discussed above, for signals that lie in the audio range, at a frequency of around 440 kHz, the sampling rate is preferably greater than 11 kHz. This is shown in the Result 6a. The results are less satisfactory due to the low sampling rate. However, the algorithm would have performed much better at a higher sampling rate.

Result 8a shown in FIG. 36 shows a 440 kHz waveform modulated at 220 kHz with a sampling rate of 6 kHz. In this example, the number of comparisons was 500 and the threshold was 0.15. The results show that although the average score has increased, score saturation has not occurred. The algorithm has still identified the anomalous region.

Result 9a shown in FIG. 37 shows data having a 440 kHz amplitude modulated sine wave. In this example, the sampling rate was 6 kHz, the number of comparisons was 250 and the threshold was 0.15. The results show good discrimination of the anomalous cycles. It is noted that some striation effects are evident.

Result 10a shown in FIG. 38 shows real audio data comprising a guitar chord with a burst of noise. In this example, the sampling rate was 11 kHz, the number of comparisons was 250 and the threshold was 0.015. Unlike the previous results, the comparison domain was not the entire data length but was 175 cycles. This was critical due to the morphing of cycles in this complex waveform. The results show that the noise has been very well identified. It is further notices that the attack and decay region, where the chord is struck and when it dies away, also score high attention (mismatch) scores, as would be expected.

The above examples show very good results. For many types of waveform the cycle comparison algorithm described here is favoured over the sample analysis algorithm described with reference to FIGS. 1 to 21. However, it is to be noted that there are some waveforms that may be more suitable for analysis by the sample analysis algorithm, for example where in a waveform it is not considered anomalous for a small amplitude cycle to be adjacent a large amplitude cycle.

It has been noticed that the cycle comparison algorithm has problems identifying a misplaced cycle in a set of ordered cycles. This is because as long as the cycle is common in other parts of the waveform, it will not be considered as an anomaly regardless of its position. Thus, preferably, it is advantageous to take more than one cycle into account while doing the comparison. Thus, the original cycle, x0, may be a plurality of cycles. n subsequent cycles, xn, together to do the comparison or to implement a random neighbourhood of cycles for comparison in the same way the algorithms described with reference to FIGS. 1 to 21 take a random neighbourhood of samples.

An error correction system is now described with reference to FIGS. 40 and 20, which has application to the present invention. Having used the anomaly detection system previously described to identify regions of anomaly in a waveform, error correction is provided to remove the detected errors. From the attention map produced as described above, a suitable filter coefficient is set (PARAMETER: filter coefficient) so that only the anomalous region remains in the map before passing the data to an error correction algorithm. The data in the attention map is stored in registers.

The error correction algorithm used depends on the algorithm used to detect the anomaly. For the cycle comparison algorithm described above is for use together with a cutting and replacing correction algorithm. However, the sample analysis algorithm described above with reference to FIGS. 1 to 21, it has been found that a shape learning error correction algorithm yields better results.

The cutting and replacement correction algorithm described below may be implemented directly. The success of the error correction however, is dependent primarily on being able to pinpoint the anomaly with confidence, which is the function of the detection algorithm.

Figure 39:
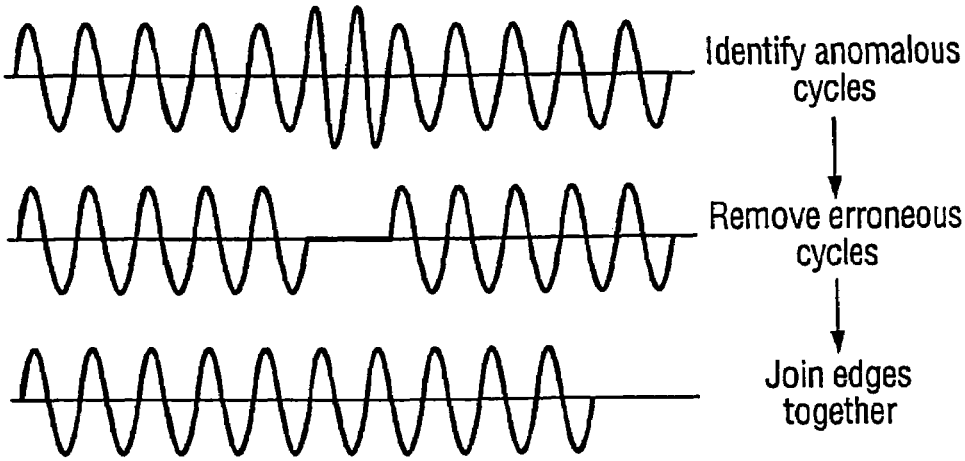
FIG. 39 shows cutting erroneous cycles.

FIG. 39 shows the steps taken to perform the cutting cycles routine. This method cuts the erroneous regions away and joins the ends together. This reduces the chances of second order noise.

Figure 40:
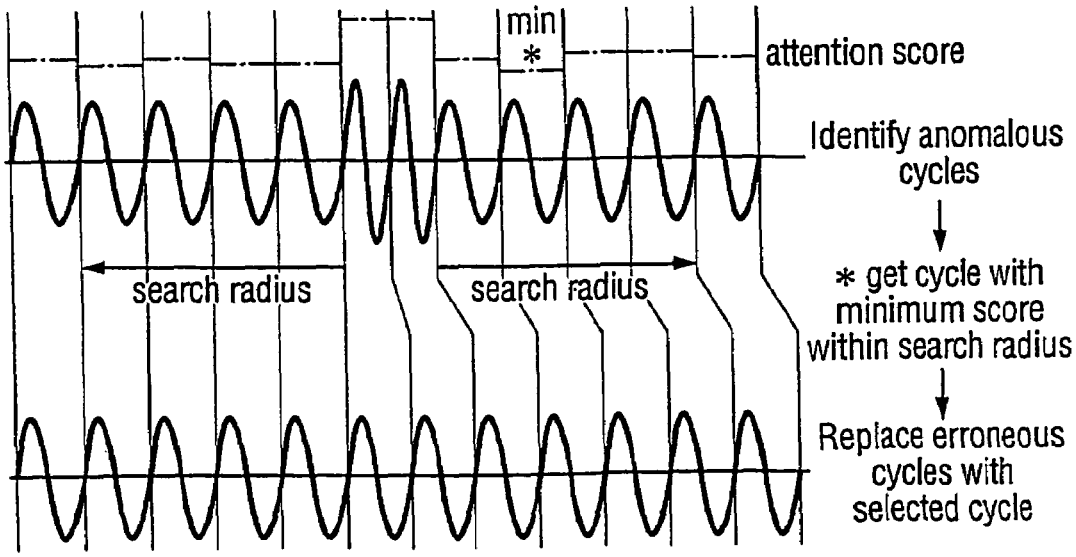
FIG. 40 shows replacing erroneous cycles.

FIG. 40 shows the steps taken to perform the replacing cycles routing. After the erroneous cycle is identified, the algorithm searches a certain number of cycles (parameter: search radius for replacement cycle) around the erroneous cycle for a cycle with the lowest score available. It then uses this cycle to replace the erroneous cycle. As with cutting cycles method, this method is best implemented if the cycle comparison algorithm is used for the detection.

A detection algorithm of the present invention has been demonstrated to be very tolerant to the type of input data as well as being very flexible in spotting anomalies in one-dimensional data. Therefore there are many applications where such detection method may be useful.

In the audio field, such a detection algorithm may be used as a line monitor to monitor recordings and playback for unwanted noise as well as being able to remove it. It may also be useful in the medical field as an automatic monitor for signals from a cardiogram or encephalogram of a patient. Apart from monitoring human signals, it may also be used to monitor engine noise. Like monitoring in humans, the output from machines, be it acoustic signals or electrical signals, deviate from its normal operating pattern as the machine's operating conditions vary, and in particular, as the machine approaches failure.

The algorithm may also be applied to seismological or other geological data and data related to the operation of telecommunications systems, such as a log of accesses or attempted accesses to a firewall.

As the detection algorithm is able to give a much earlier warning in the case of systems that are in the process of failing, in addition to monitoring and removing errors, it may also be used as a predictor. This aspect has application for example, in monitoring and predicting traffic patterns.

The invention can be described in generally terms as set out in the set of numbered clauses below:

1. A method of recognising anomalies contained within a set of data derived from an analogue waveform, the data represented by an ordered sequence of data elements each having a value, in respect of at least some of said data elements, including the steps of: selecting a group of test elements comprising at least two elements of the sequence; selecting a group of comparison elements comprising at least two elements of the sequence, wherein the comparison group has the same number of elements as the test group and wherein the elements of the comparison group have relative to one another the same positions in the sequence as have the elements of the test group; comparing the value of each element of the test group with the value of the correspondingly positioned element of the comparison group in accordance with a predetermined threshold to produce a decision that the test group matches or does not match the comparison group; selecting further said comparison groups and comparing them with the test group; generating a distinctiveness measure as a function of the number of comparisons for which the comparison indicates a mismatch. 2. A method according to clause 1 including the further step of: identifying ones of said positional relationships which give rise to a number of consecutive mismatches which exceeds said threshold. 3. A method according to clause 2 including the further steps of: storing a definition of each such identified relationship; and utilising the stored definitions for the processing of further data. 4. A method according to clause 2 or clause 3 including the further step of: replacing said identified ones with data which falls within the threshold. 5. A method according to any preceding clause, wherein the time resolved data is an audio signal. 6. A method of removing noise from a sequence of data represented by an ordered sequence of data elements each having a value comprising, in respect of at least some of said data elements, including the steps of: selecting a group of comparison elements comprising at least two elements of the sequence, wherein the comparison group has the same number of elements as the test group and wherein the elements of the comparison group have relative to one another the same positions in the sequence as have the elements of the test group; comparing the value of each element of the test group with the value of the correspondingly positioned element of the comparison group in accordance with a predetermined match criterion to produce a decision that the test group matches or does not match the comparison group; selecting further said comparison groups and comparing them with the test group; generating a distinctiveness measure as a function of the number of comparisons for which the comparison indicates a mismatch, identifying ones of said positional relationships which give rise to a number of consecutive mismatches which exceeds a threshold, and replacing said identified ones with data which falls within the threshold. 7. A computer programmed to perform the method of any of clauses 1-6. 8. A computer program product directly loadable into the internal memory of a digital computer, comprising software code portions for performing the steps of any of clauses 1-6, when said product is run on a computer. 9. An apparatus for recognising anomalies contained within a set of data derived from an analogue waveform, the data represented by an ordered sequence of data elements each having a value comprising, in respect of at least some of said data elements, including: means for storing an ordered sequence of data, each datum having a value, means for selecting a group of test elements comprising at least two elements of the sequence; means for selecting a group of comparison elements comprising at least two elements of the sequence, wherein the comparison group has the same number of elements as the test group and wherein the elements of the comparison group have relative to one another the same positions in the sequence as have the elements of the test group; means for comparing the value of each element of the test group with the value of the correspondingly positioned element of the comparison group in accordance with a predetermined match criterion to produce a decision that the test group matches or does not match the comparison group; means for selecting further said comparison groups and comparing them with the test group; means for generating a distinctiveness measure as a function of the number of comparisons for which the comparison indicates a mismatch. 10. A computer program product stored on a computer usable medium, comprising: computer readable program means for causing a computer to store an ordered sequence of data derived from an analogue waveform, each datum having a value, computer readable program means for causing a computer to select a group of test elements comprising at least two elements of the sequence; computer readable program means for causing a computer to select a group of comparison elements comprising at least two elements of the sequence, wherein the comparison group has the same number of elements as the test group and wherein the elements of the comparison group have relative to one another the same positions in the sequence as have the elements of the test group; computer readable program means for causing a computer to compare the value of each element of the test group with the value of the correspondingly positioned element of the comparison group in accordance with a predetermined match criterion to produce a decision that the test group matches or does not match the comparison group; computer readable program means for causing a computer to select further said comparison groups and comparing them with the test group; computer readable program means for causing a computer to generate a distinctiveness measure as a function of the number of comparisons for which the comparison indicates a mismatch. 11. A method of recognising anomalies in data represented by an ordered array of data elements each having a value, in respect of at least some of said data elements, including the steps of: selecting a group of test elements comprising at least two elements of the array; selecting a group of comparison elements comprising at least two elements of the array, wherein the comparison group has the same number of elements as the test group and wherein the elements of the comparison group have relative to one another the same positions in the array as have the elements of the test group; comparing the value of each element of the test group with the value of the correspondingly positioned element of the comparison group in accordance with a dynamic threshold, whose value varies in accordance with the values of the elements around at least one of said test elements, to produce a decision that the test group matches or does not match the comparison group; selecting further said comparison groups and comparing them with the test group; generating a distinctiveness measure as a function of the number of comparisons for which the comparison indicates a mismatch. 12. A method according to clause 1, including the further step of: determining the local gradient at one of said test elements. 13. A method according to clause 2, including the further step of: using said local gradient to determine the dynamic threshold. 14. A method according to any of the preceding clauses wherein the dynamic threshold is determined in accordance with the local gradient and a predetermined threshold. 15. A method according to clause 1, including the further step of: determining the value of the elements neighbouring one of said test elements. 16. A method according to clause 6, wherein the dynamic threshold is determined in accordance with said value of the elements neighbouring one of said test elements. 17. A method according to clause 1 including the further step of: identifying ones of said positional relationships which give rise to a number of consecutive mismatches which exceeds said threshold. 18. A method according to clause 7 including the further steps of: storing a definition of each such identified relationship; and utilising the stored definitions for the processing of further data. 19. A method according to clause 7 or clause 8 including the further step of: replacing said identified ones with data which falls within the threshold. 20. A computer programmed to perform the method of any of clauses 11-19. 21. A computer program product directly loadable into the internal memory of a digital computer, comprising software code portions for performing the steps of any of clauses 11-19, when said product is run on a computer. 22. An apparatus for recognising anomalies in data represented by an ordered array of data elements each having a value, in respect of at least some of said data elements, including: means for storing an ordered array of data, each datum having a value, means for selecting a group of test elements comprising at least two elements of the array; means for selecting a group of comparison elements comprising at least two elements of the array, wherein the comparison group has the same number of elements as the test group and wherein the elements of the comparison group have relative to one another the same positions in the array as have the elements of the test group; means for comparing the value of each element of the test group with the value of the correspondingly positioned element of the comparison group in accordance with a dynamic threshold to produce a decision that the test group matches or does not match the comparison group; means for selecting further said comparison groups and comparing them with the test group; means for generating a distinctiveness measure as a function of the number of comparisons for which the comparison indicates a mismatch. 23. An apparatus according to clause 22, including means for determining the local gradient at one of said test elements. 24.

An apparatus according to clause 23, including means for determining the dynamic threshold using said local gradient. 25. An apparatus according to any of clauses 22-24, wherein dynamic threshold is determined in accordance with the local gradient and a predetermined threshold. 26. An apparatus according to clause 22 including means for determining the value of the elements neighbouring one of said test elements. 27. An apparatus according to clause 26, wherein the dynamic threshold is determined in accordance with said value of the elements neighbouring one of said test elements. 28. An apparatus according to clause 22 including means for identifying ones of said positional relationships which give rise to a number of consecutive mismatches which exceeds said threshold. 29. An apparatus according to clause 28 including means for storing a definition of each such identified relationship; and utilising the stored definitions for the processing of further data. 30. An apparatus according to clause 28 or 29 including means for replacing said identified ones with data which falls within the threshold. 31. A computer program product stored on a computer usable medium, comprising: computer readable program means for causing a computer to store an ordered array of data, each datum having a value, computer readable program means for causing a array; computer readable program means for causing a computer to select a group of comparison elements comprising at least two elements of the array, wherein the comparison group has the same number of elements as the test group and wherein the elements of the comparison group have relative to one another the same positions in the array as have the elements of the test group; computer readable program means for causing a computer to compare the value of each element of the test group with the value of the correspondingly positioned element of the comparison group in accordance with a dynamic threshold to produce a decision that the test group matches or does not match the comparison group; computer readable program means for causing a computer to select further said comparison groups and comparing them with the test group; computer readable program means for causing a computer to generate a distinctiveness measure as a function of the number of comparisons for which the comparison indicates a mismatch. 32. A method of recognising anomalies in data represented by an ordered array of data elements each having a value, in respect of at least some of said data elements, including the steps of: i) selecting a first test element from said array, ii) selecting a random reference element from said array, iii) comparing the value of the test element with the value of the random reference element, iv) if the value of said test element does not match the value of said random reference element searching for a matching element within the neighbourhood of said random reference element, v) changing a mismatch parameter as a measure of anomalies in said data array if no matching element within said neighbourhood of said random reference element is found and selecting a new random reference element, vi) repeating steps iii) to v) a number of times. 33. A method according to clause 32 including the steps of: vii) if in step iv) a matching element is found within said neighbourhood of said random reference element performing a comparison of the values of elements of a group of elements about said first test element with the values of a corresponding group of elements about said matching element, viii) if said groups are found to match increasing a comparison value. 34. A method according to clause 33 wherein said elements of said group of elements about said first test element and said elements of said group of elements about said matching element are arranged in the same manner about said test element and said matching element respectively and corresponding elements of said groups are compared in accordance with a threshold value. 35. A method according to clause 33 in which step vi) is repeated until said comparison value is equal to a set value and when said comparison value is equal to said set value selecting a second test element and repeating steps i) to vi) for said second test element. 36. A method according to clause 34, wherein the values are compared in accordance with a dynamic threshold, the value of which varies in accordance with the values of the elements around at least one of the test elements. 37. A method according to clause 36, including the further step of: determining the local gradient at one of said test elements. 38. A method according to clause 39, including the further step of: using said local gradient to determine the dynamic threshold. 39. A method according to any of preceding clauses 36 to 38 wherein the dynamic threshold is determined in accordance with the local gradient and a predetermined threshold. 40. A method according to clause 34 including the further step of: identifying the particular arrangements of elements which give rise to a number of consecutive mismatches which exceeds said threshold and storing data representing such particular arrangements of elements. 41. A method according to clause 40 including the further step of: replacing said stored data with corresponding data of arrangements giving rise to matches falling within the threshold. 42. A computer programmed to perform the method of any of clauses 31-41. 43. A computer program product directly loadable into the internal memory of a digital computer, comprising software code portions for performing the steps of any of clauses 31-41, when said product is run on a computer. 44. An apparatus for recognising anomalies in data represented by an ordered array of data elements each having a value, in respect of at least some of said data elements, means for selecting a first test element from said array, means for selecting a random reference element from said array, means for comparing the value of the test element with the value of the random reference element, means for searching for a matching element within the neighbourhood of said random reference element if the value of said test element does not match the value of said random reference element, means for changing a mismatch parameter as a measure of anomalies in said data array if no matching element is found within said neighbourhood of said random reference element and for selecting a new random reference element. 45. An apparatus according to clause 44, wherein if a matching element is found within said neighbourhood of said random reference element means are provided to perform a comparison of the values of elements of a group of elements about said first test element with the values of a corresponding group of elements about said matching element, and if said groups are found to match means are provided to increase a comparison value. 46. An apparatus according to clause 45 wherein said elements of said group of elements about said first test element and said elements of said group of elements about said matching element are arranged in the same manner about said test element and said matching element respectively and corresponding elements of said groups are compared in accordance with a threshold value. 47. An apparatus according to clause 45, including means for repeating step vi) until said comparison value is equal to a set value and when said comparison value is equal to said set value selecting a second test element and including means for repeating steps i) to vi) for said second test element. 48. An apparatus according to clause 46, wherein the values are compared in accordance with a dynamic threshold, the value of which varies in accordance with the values of the elements around at least one of the test elements. 49. An apparatus according to clause 48, including means for determining the local gradient at one of said test elements. 50. An apparatus according to clause 49 including means for using said local gradient to determine the dynamic threshold. 51. An apparatus according to any one of clauses 48-50, wherein the dynamic threshold is determined in accordance with the local gradient and a predetermined threshold. 52. An apparatus according to clause 46, including means for identifying the particular arrangements of elements which give rise to a number of consecutive mismatches which exceeds said threshold and storing data representing such particular arrangements of elements. 53. An apparatus according to clause 52, including means for replacing said stored data with corresponding data of arrangements giving rise to matches falling within the threshold. 54. An apparatus according to clause 44 including means for identifying ones of said test elements which give rise to a number of consecutive mismatches which exceed said threshold. 55. An apparatus according to clause 54 including means for storing a definition of each such test elements; and utilising the stored test elements for the processing of further data. 56. An apparatus according to clause 54 or 55 including means for replacing said identified ones with data which falls within the threshold. 57. A computer program product stored on a computer usable medium, comprising: computer readable program means for causing a computer to store an ordered array of data elements each having a value, in respect of at least some of said data elements, computer readable program means for causing a computer to select a first test element from said array, computer readable program means for causing a computer to select a random reference element from said array, computer readable program means for causing a computer to compare the value of the test element with the value of the random reference element, computer readable program means for causing a computer to search for a matching element within the neighbourhood of said random reference element if the value of said test element does not match the value of said random reference element, computer readable program means for causing a computer to change a mismatch parameter as a measure of anomalies in said data array if no matching element is found within said neighbourhood of said random reference element and for selecting a new random reference element. 58. A method of recognising anomalies contained within an array of data elements, each element having a value, including the steps of, in respect of at least some of said data elements, i) identifying cycles in the set of data in accordance with predetermined criteria, ii) selecting a test cycle of elements from said set of data, iii) randomly selecting a comparison cycle from said set of data, iv) determining an integration value for said test cycle and said reference cycle respectively, v) comparing said integration values and deriving therefrom a measure of the difference of said test and said reference cycles, vi) using said measure to determine a mismatch of said test and said reference cycles. 59. A method according to clause 58, including the further step of: vii) randomly selecting further reference cycles and comparing them with the test cycle according to steps v) and vi) and counting the number of mismatches. 60. A method according to clause 58 in which a mismatch is determined by comparing said measure to a threshold value. 61. A method according to clause 59, including the further step of: viii) generating a distinctiveness measure as a function of the number of mismatches between test and reference cycles. 62. A method according to any preceding clause, including the further step of: ix) establishing whether the test and reference cycles include the same number of elements, and if the number of elements are not equal, padding the cycle with fewer elements with elements of set value, so that both cycles contain the same number of elements. 63. A method according to any preceding clause, in which step iv) comprises determining the difference of the sums of values of the element of the test cycle and the comparison cycle respectively. 64. A method according to clause 59 in which step vii) is repeated a set number of times, after which a fresh test cycle is selected. 65. A computer programmed to perform the method of any of clauses 58 to 64. 66. A computer program product directly loadable into the internal memory of a digital computer, comprising software code portions for performing the steps of any of clauses 58 to 64, when said product is run on a computer. 67. An apparatus for recognising anomalies contained within an array of data elements, each element having a value, the apparatus including: means for identifying cycles in the set of data in accordance with predetermined criteria, means for selecting a test cycle of elements from said set of data, means for randomly selecting a comparison cycle from said set of data, means for determining an integration value for said test cycle and said reference cycle respectively, means for comparing said integration values and deriving therefrom a measure of the difference of said test and said reference cycles, means for using said measure to determine a mismatch of said test and said reference cycles. 68. An apparatus according to clause 67, further including: means for randomly selecting further reference cycles and comparing them with the test cycle, and means for counting the number of mismatches. 69. An apparatus according to clause 67, in which a mismatch is determined by comparing said measure to a threshold value. 70.

An apparatus according to clause 68 or clause 69, further including: means for generating a distinctiveness measure as a function of the number of mismatches between test and reference cycles. 71. An apparatus according to any of clauses 67 to 70, further including: means for establishing whether the test and reference cycles include the same number of elements, and if the number of elements are not equal, padding the cycle with fewer elements with elements of set value, so that both cycles contain the same number of elements. 72. An apparatus according to any of clauses 68 to 71, wherein said determining means determines the difference of the sums of values of the element of the test cycle and the comparison cycle respectively. 73. An apparatus according to clause 68, including means for selecting a fresh test cycle after the comparison means is repeated a predetermined number of times. 74. A computer program product stored on a computer usable medium, comprising: computer readable program means for causing a computer to identify cycles in the set of data in accordance with predetermined criteria, computer readable program means for causing a computer to select a test cycle of elements from said set of data, computer readable program means for causing a computer to randomly select a comparison cycle from said set of data, computer readable program means for causing a computer to determine an integration value for said test cycle and said reference cycle respectively, computer readable program means for causing a computer to compare said integration values and deriving therefrom a measure of the difference of said test and said reference cycles, computer readable program means for causing a computer to use said measure to determine a mismatch of said test and said reference cycles. 75. A computer program product stored on a computer usable medium according to clause 74, further comprising: computer readable program means for causing a computer to select further said comparison cycles and comparing them with the test cycle. 76. A computer program product stored on a computer usable medium according to either clause 74 or 75, further comprising: computer readable program means for causing a computer to generate a distinctiveness measure as a function of the number of comparisons for which the comparison indicates a mismatch.

What is claimed is:

1. A computer implemented method of recognizing anomalies in acoustic data representative of an analog waveform, the analog waveform varying in value as a function of time and having a plurality of cycles, the acoustic data comprising a one-dimensional ordered sequence of data elements, each element being representative of a respective analog value, the method comprising:

using at least one computer with accessible input/output and at least one data store to perform the following steps:

(i) selecting a test group of test elements from the acoustic data;

(ii) selecting a comparison group of comparison elements from the acoustic data;

(iii) performing a comparison between the analog values of the test group and the analog values of the comparison group, the comparison involving the test elements of the test group on the one hand and the comparison elements of the comparison group on the other hand;

(iv) determining as a result of the comparison whether there is a match or a mismatch between the analog values of the test group and the analog values of the comparison group;

(v) repeating steps (ii), (iii), and (iv), incrementing the value of a mismatch counter each time a mismatch is found;

(vi) determining an anomaly measure representative of the anomaly of one or more of the test elements, the anomaly measure being dependent on mismatch counter value and being produced in said at least one data store.

2. The method as claimed in claim 1, wherein a comparison value is generated as a result of the comparison between the test group and the comparison group, a mismatch being determined in dependence on the generated comparison value relative to a threshold value.

3. The method as claimed in claim 1, wherein the anomaly measure is the value of the mismatch counter.

4. The method as claimed in claim 1, wherein the steps (i) to (vi) are repeated so as to generate an anomaly measure for each of the elements in the sequence.

5. The method as claimed in claim 1, wherein steps (ii), (iii) and (iv) are repeated until a match is found between the test group and the comparison group.

6. The method as claimed in claim 1, wherein steps (ii), (iii) and (iv) are repeated a predetermined number of times.

7. The method as claimed in claim 1, wherein:

the test group includes a reference test element and the comparison group includes a reference comparison element, and the comparison elements are selected such that the respective position of comparison elements in the sequence relative to the reference comparison element is the same as that of the test elements relative to the reference test element, the comparison involving comparing the value of each test element of the test group with the correspondingly positioned comparison element of the comparison group, the mismatch counter being incremented in dependence on the difference between the values of the correspondingly positioned elements in relation to a threshold value.

8. The method as claimed in claim 7, wherein the position in the sequence of the test elements relative to the reference test element is selected randomly from those elements within a predetermined neighborhood range relative to the reference test element, and/or wherein the position of the reference comparison element is selected randomly within a predetermined comparison range relative to the reference test element.

9. The method as claimed in claim 8, wherein if a match between the test group and a comparison group is found, the step of randomly selecting test elements within the predetermined neighborhood range is repeated.

10. The method as claimed in claim 7, wherein the threshold value is dependent on the gradient of the waveform at the point in the waveform which the reference test element represents.

11. The method as claimed in claim 7, wherein the difference in value of each pair of correspondingly positioned elements in the respective test group and comparison group are compared to a threshold value, the threshold value for each pair being dependent on the gradient of one or both elements of the pair.

12. The method as claimed in claim 1, wherein a threshold value is dependent on the gradient of the waveform at some or each of the elements being used to perform a comparison between the elements of the test group and those of the comparison group.

13. The method as claimed in claim 12, wherein the gradient is equal to the difference in value of two adjacent elements.

14. The method as claimed in claim 1, including the further step of (a) determining if the value of the reference comparison element is within a predetermined range of the value of the reference test element, and if the value of the reference comparison is outside the predetermined range, (b) selecting again a reference comparison element.

15. The method as claimed in claim 14, wherein the steps (a), (b) of claim 14 are repeated until one of a plurality of stop conditions is met, the stop conditions including: (1) that a match is found between the test group and a comparison group; and (ii) that each element within a test range has been selected as a reference comparison element, the mismatch counter being incremented when a stop condition is met.

16. The method as claimed in claim 14, wherein if a first comparison reference element is selected that is outside the predetermined range, a second comparison reference element is selected that is a predetermined interval away in the ordered sequence from the first selected comparison reference element.

17. The method as claimed in claim 1, including the further step of identifying cycles in a set of data in accordance with predetermined criteria, wherein the test group of test elements is formed by one of the identified cycles, and the comparison group of comparison elements is formed by another of the identified cycles, and wherein the step of performing a comparison between the comparison group and the test group includes determining a respective integration value for the test group and the comparison group, and comparing the integration values of each group.

18. The method as claimed in claim 17, wherein the step of performing a comparison between the comparison group and the test group involves determining a respective combination of the values of the elements of the test group and those of the comparison group, and evaluating the difference in the respective combinations.

19. The method as claimed in claim 18, wherein the combination is a sum.

20. The method as claimed in claim 1, wherein the acoustic source data is audio data.

21. A computer program product stored in a memory of a computer the computer program product directly loadable into the memory of a digital computer device, said program comprising software code portions for performing the steps of claim 1, when the product is run on a digital computer device.

22. A computer program product stored in a computer memory device, the computer program product being configured for, in use, recognizing anomalies in acoustic data representative of an analog waveform varying in value as a function of time and having a plurality of cycles, the acoustic data comprising a one-dimensional ordered sequence of data elements, each element being representative of a respective analog value, the computer program product having:

computer-readable program means adopted for use with at least one computer with accessible input/output and at least one data store for:

selecting a test group of test elements from the acoustic data;

selecting a comparison group of comparison elements from the acoustic data;

performing a comparison between the analog values of the test group and the analog values of the comparison group, the comparison involving the test elements of the test group on the one hand and the comparison elements of the comparison group on the other hand;

determining as a result of the comparison whether there is a match or a mismatch between the analog values of the test group and the analog values of the comparison group; and determining an anomaly measure representative of the anomaly of one or more of the test elements, the anomaly measure being dependent on mismatch counter value and being produced in said at least one data store.

23. The computer readable media as claimed in claim 22, wherein the acoustic source data is audio data.

24. A computer implemented apparatus for recognizing anomalies in acoustic data representative of an analog waveform varying in value as a function of time and having a plurality of cycles, the acoustic data comprising a one-dimensional ordered sequence of data elements, each element being representative of a respective analog value, the apparatus including:

at least one computer accessible to input/output and at least one data store;

means for selecting a test group of test elements from the acoustic data;

means for selecting a comparison group of comparison elements from the acoustic data;

means for performing a comparison between the analog values of the test group and the analog values of the comparison group, the comparison involving the test elements of the test group on the one hand and the comparison elements of the comparison group on the other hand;

means for determining as a result of the comparison whether there is a match or a mismatch between the analog values of the test group and the analog values of the comparison group; and means for determining an anomaly measure representative of the anomaly of one or more of the test elements, the anomaly measure being dependent on mismatch counter value and being produced in said at least one data store.

25. The apparatus as claimed in claim 24, wherein the acoustic source data is audio data.

* * * * *